US008393879B2

(12) United States Patent
Kent

(10) Patent No.: US 8,393,879 B2
(45) **Date of Patent: *Mar. 12, 2013**

(54) PERISTALTIC PUMP

(75) Inventor: Blair M. Kent, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 3094 days.

This patent is subject to a terminal disclaimer.

(21) Appl. No.: 10/832,499

(22) Filed: Apr. 27, 2004

(65) Prior Publication Data

US 2005/0238516 A1 Oct. 27, 2005

(51) Int. Cl.
*F04B 43/12* (2006.01)
*F04B 45/06* (2006.01)

(52) U.S. Cl. ..... 417/477.8; 417/477.12

(58) Field of Classification Search ..... 417/475, 417/476, 477.3, 477.8, 477.9, 477.7, 477.11, 417/477.12

See application file for complete search history.

(56) References Cited

U.S. PATENT DOCUMENTS 3,679,331 A 7/1972 Kushner
3,723,030 A * 3/1973 Gelfand ..... 417/475
3,739,717 A 6/1973 Brown et al.
3,740,173 A 6/1973 Natelson
3,791,777 A 2/1974 Papoff et al.
3,832,096 A * 8/1974 Gelfand ..... 417/475
4,544,336 A 10/1985 Faeser et al.
4,547,136 A 10/1985 Rothstein
4,586,882 A * 5/1986 Tseng ..... 417/477.3
4,673,334 A * 6/1987 Allington et al. ..... 417/53
4,886,431 A 12/1989 Soderquist et al.
4,976,593 A 12/1990 Miyamoto
5,064,358 A * 11/1991 Calari ..... 417/475
5,096,393 A 3/1992 Van Steenderen et al.
5,098,261 A 3/1992 Bertoncini
5,249,937 A * 10/1993 Aubert ..... 417/475
5,257,917 A 11/1993 Minarik et al.
5,447,417 A 9/1995 Kuhl et al.
5,846,061 A 12/1998 Ledebuhr et al.
6,033,060 A 3/2000 Minami
6,041,709 A * 3/2000 Wells et al. ..... 417/475
6,082,851 A 7/2000 Shihoh et al.
6,102,678 A * 8/2000 Peclat ..... 417/477.7
6,322,330 B1 * 11/2001 Thomas ..... 417/360
6,419,466 B1 7/2002 Lowe et al.
6,551,080 B2 4/2003 Andersen et al.
2005/0238515 A1 * 10/2005 Kent ..... 417/476

* cited by examiner

*Primary Examiner* — Peter J Bertheaud

(57) ABSTRACT

A peristaltic pump includes opposing occlusion surfaces and a rotor between the occlusion surfaces. The rotor carries a set of occluding surfaces. At least one of either the set of occluding surfaces or the opposing occlusion surfaces are linearly movable relative to the other of the set of occluding surfaces and the occlusion surfaces.

39 Claims, 12 Drawing Sheets

PERISTALTIC PUMP

CROSS-REFERENCE TO RELATED PATENT APPLICATION

The present application is related to U.S. patent application Ser. No. 10/832,536 titled Peristaltic Pump and filed on the same date as the present application by Blair M. Kent, the full disclosure of which is hereby incorporated by reference.

BACKGROUND

Peristaltic pumps are used in a wide variety of applications for pumping fluid. Peristaltic pumps typically include a set of rollers which are rotated against a fluid-filled tube to compress the tube against an occlusion to move the fluid within the tube. Peristaltic pumps are very susceptible to the physical difference or gap between the roller and the occlusion. If the gap is too large, the pump does not move fluid within the tube. If the gap is too small, the tube is excessively compressed which requires additional torque to move the pump and which increases wear of the tube.

Multiple peristaltic pump systems rotate one or more rotors about a single axis against multiple fluid-filled tubes to compress the tubes against multiple occlusions. In such systems, a peak torque occurs during the time at which the rollers of each rotor simultaneously compress their respective tubes. During a period of prolonged rest, the rollers create a tube compressive set in each of the tubes. A secondary torque spike also occurs when the rollers of each rotor simultaneously encounter the tube compressive set during pumping. There is a continuing need to minimize torque requirements for multiple peristaltic pump systems to reduce power requirements and associated costs.

DETAILED DESCRIPTION

Figure 1:
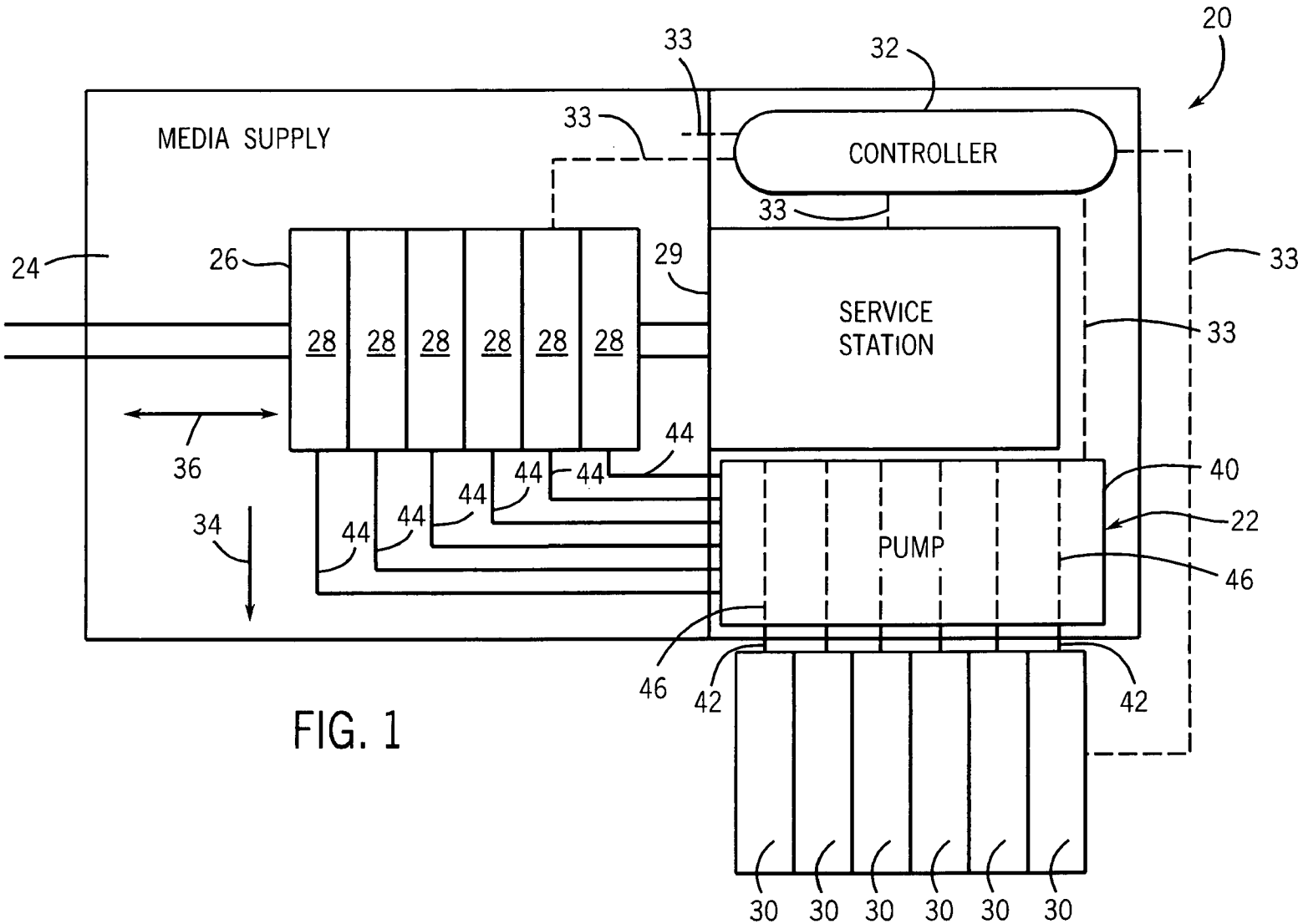
FIG. 1 is a schematic illustrating an example of an image-forming device including an example of a peristaltic pump according to an exemplary embodiment of the present invention.

FIG. 1 schematically illustrates image-forming device 20 utilizing one example of a fluid delivery system 22 of the present invention. In addition to fluid delivery system 22, image-forming device 20 includes media supply 24, carriage 26, fluid-dispensing devices 28, fluid supplies 30 and controller 32. Media supply 24 comprises a mechanism configured to supply and position media, such as paper, relative to carriage 26 and fluid-dispensing devices 28. Carriage 26 comprises a conventionally known or future developed mechanism for moving fluid-dispensing devices 28 relative to the medium provided by media supply 24. In the particular embodiment illustrated, media supply 24 moves the medium relative to carriage 26 and fluid-dispensing devices 28 in the direction indicated by arrow 34 while carriage 26 moves fluid-dispensing devices 28 repeatedly across the medium in the directions indicated by arrow 36.

Fluid-dispensing devices 28 comprise devices configured to dispense fluid upon a medium. In the particular embodiment illustrated, devices 28 comprise print cartridges including printheads with nozzles for dispensing fluid ink upon the medium. Service station 29 is a conventionally known service station configured to service fluid-dispensing devices 28. Examples of servicing operations include wiping, spitting, and capping. Fluid supplies 30 provide ink reservoirs containing one or more chromatic or achromatic inks to fluid-dispensing devices 28. Fluid supplies 30 and fluid delivery system 22 function as an ink supply system for image-forming device.

Fluid delivery system 22 moves ink from fluid supplies 30 to fluid-dispensing devices 28. Fluid delivery system 22 includes peristaltic pump 40 and fluid ink conduits 42, 44. As will be described in greater detail hereafter, peristaltic pump 40 includes pumping tubes 46. Fluid conduits 42 fluidly connect the ink reservoirs provided by fluid supplies 30 to pumping tubes 46. Fluid conduits 44 fluidly interconnect pumping tubes 46 to fluid-dispensing devices 28. In one embodiment, fluid conduits 42, fluid conduits 44 and pumping tubes 46 form a complete circuit between fluid dispensing devices 28 and fluid supplies 30. As such, each line shown in FIG. 1 and designated by reference numerals 42, 44 and 46 schematically represents a pair of conduits or tubes. In such an embodiment, conduits 42, conduits 44 and pumping tubes 46 deliver fluid, such as ink, fluid supplies 30 to dispensing devices 28. In addition, conduits 42, conduits 44 and pumping tubes 46 deliver or return fluid from dispensing devices 28 to supplies 30. In other embodiments, conduits 42, conduits 44 and pumping tubes 46 may only deliver fluid in one direction from supplies 30 to dispensing devices 28. As such, each line designated in FIG. 1 with a reference numeral 42, 44 or 46 schematically represents a single tube or conduit.

The actual length of conduits 42 and 44 may vary depending upon the actual proximity of fluid supplies 30, pump 40 and maximum/minimum distance between fluid-dispensing devices 28 and pump 40. In particular applications, conduits 42 and 44 are releasably connected to pumping tubes 46 by fluid couplers. In alternative embodiments, one of conduits 42, 44 or both of conduits 42, 44 may be integrally formed as part of a single unitary body with pumping tubes 46. In the embodiment shown, conduits 42 and 44 have a smaller cross sectional flow area as compared to pumping tubes 46 such that pumping tubes 46 may be sized for higher pumping rates. In alternative embodiments, conduits 42, 44 and pumping tubes 46 may have similar internal cross sectional flow areas. In another embodiment, each of the plurality of conduits 44, each of the plurality of conduits 42 and each of the plurality of tubes 46 are substantially identical to one another. In alternative embodiments, pump 40 may be provided with different individual pumping tubes 46, different individual conduits 42 or different individual conduits 44. Although pumping tubes 46 include a flexible wall portion enabling pumping tubes 46 to be compressed, conduits 42 and 44 may be provided by flexible tubing or may be provided by inflexible tubing or other structures having molded or internally formed fluid passages. Although image-forming device is illustrated as having six fluid-dispensing devices 28, six fluid supplies 30, six sets of pumping tubes 46, six sets of conduits 42 and six sets of conduits 44, image-forming device may alternatively have a greater or fewer number of such components depending upon the number of different inks utilized by image-forming device and whether fluid flow is to be unidirectional or circulated.

Controller 32 communicates with media supply 24, carriage 26, fluid-dispensing devices 28, fluid supplies 30 and fluid delivery system 22 via communication lines 33 in a conventionally known manner to form an image upon medium 24 utilizing ink supplied from fluid supplies 30. Controller 32 comprises a conventionally known processor unit. For purposes of this disclosure, the term "processor unit" shall include a conventionally known or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 32 is not limited to any specific combination of hardware circuitry and software, nor to any particular source for the instructions executed by the processing unit.

Although fluid delivery system 22 is illustrated as being employed in a image-forming device in which both the medium and fluid-dispensing devices 28 are moved relative to one another to form an image upon a medium, fluid delivery system 22 may alternatively be employed in other printers to move fluid ink from one or more ink supplies to one or more ink-dispensing printheads or nozzles. For example, fluid delivery system 22 may alternatively be employed in a printer in which ink-dispensing nozzles are provided across a medium as the medium is moved in the direction indicated by arrow 34. This printer is commonly referred to as a page-wide-array printer. In still other embodiments, fluid delivery system 22 may be employed in other image-forming devices where fluid ink is deposited upon a medium by means other than pens or printheads or wherein the medium itself is held generally stationary as the ink is deposited upon the medium. Overall, fluid delivery system 22 may be utilized in any image-forming device which utilizes ink or other fluid to be deposited upon a medium.

Figure 2:
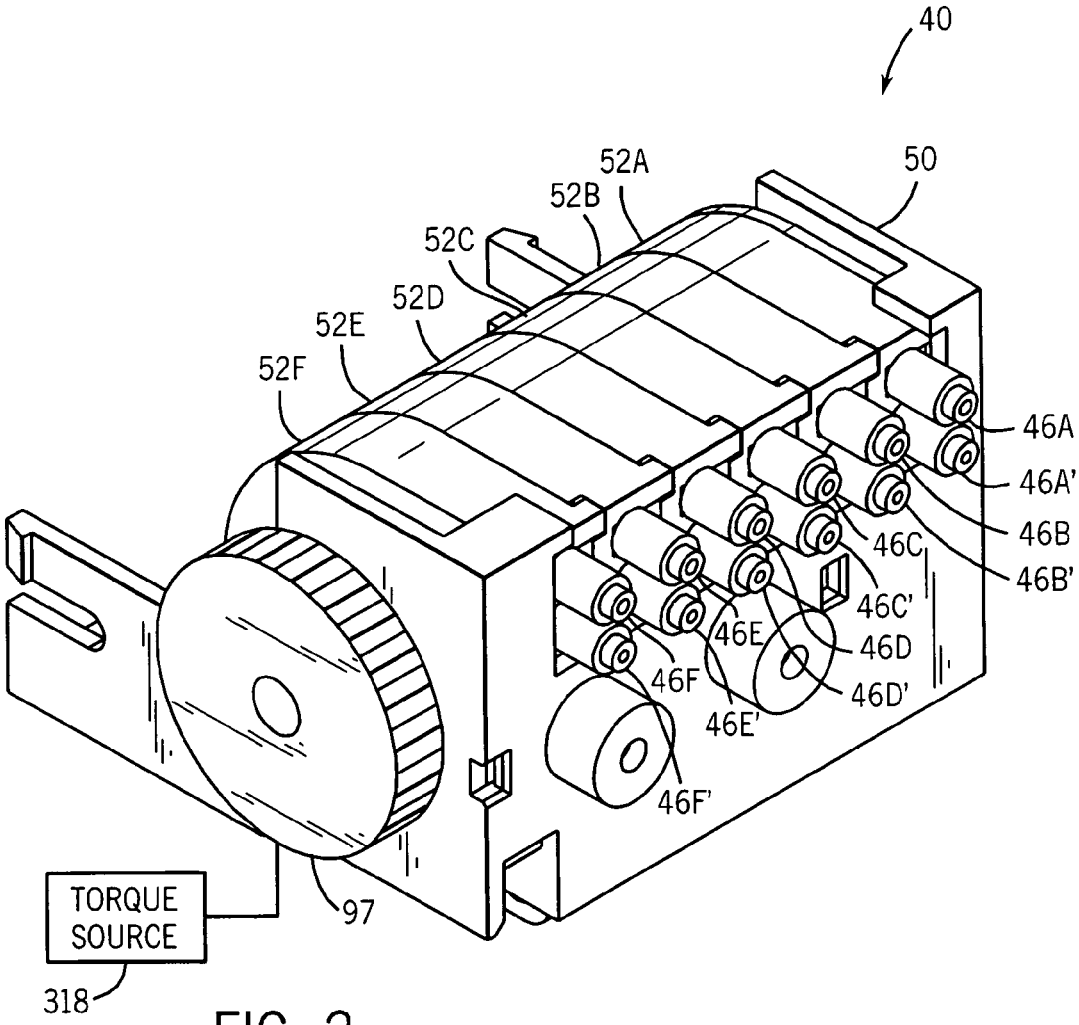
FIG. 2 is a top perspective view of the peristaltic pump of FIG. 1, according to an exemplary embodiment.

FIGS. 2-5 illustrate peristaltic pump 40 in greater detail. As best shown by FIG. 2, pump 40 includes an outer housing or frame 50, pump units 52A-52F and a drive shaft 54 (shown in FIG. 3). Frame 50 generally comprises an outer structure configured to support and retain each of units 52A-52F relative to one another as a single assembly. In the particular embodiment illustrated, frame 50 is configured to prevent rotation of units 52A-52F while permitting units 52A-52F to move relative to one another in one or more directions perpendicular to a common rotational axis 68 of units 52A-52F. As a result, each is able to center itself relative to neighboring pumps 52A-52F. Because each pump unit 52A-52F utilizes a common drive shaft 54, the number of parts, the overall size and the manufacturing and assembly costs are reduced.

In alternative embodiments, units 52A-52F may be mounted or secured relative to one another by other structures or may be directly secured to one another while omitting an overall outer frame. In still other embodiments, portions of two or more units 52A-52F may be integrally formed as a single unitary body. Although pump 40 is illustrated as including six individual units, pump 40 may alternatively include a greater or fewer number of such units.

Figure 3:
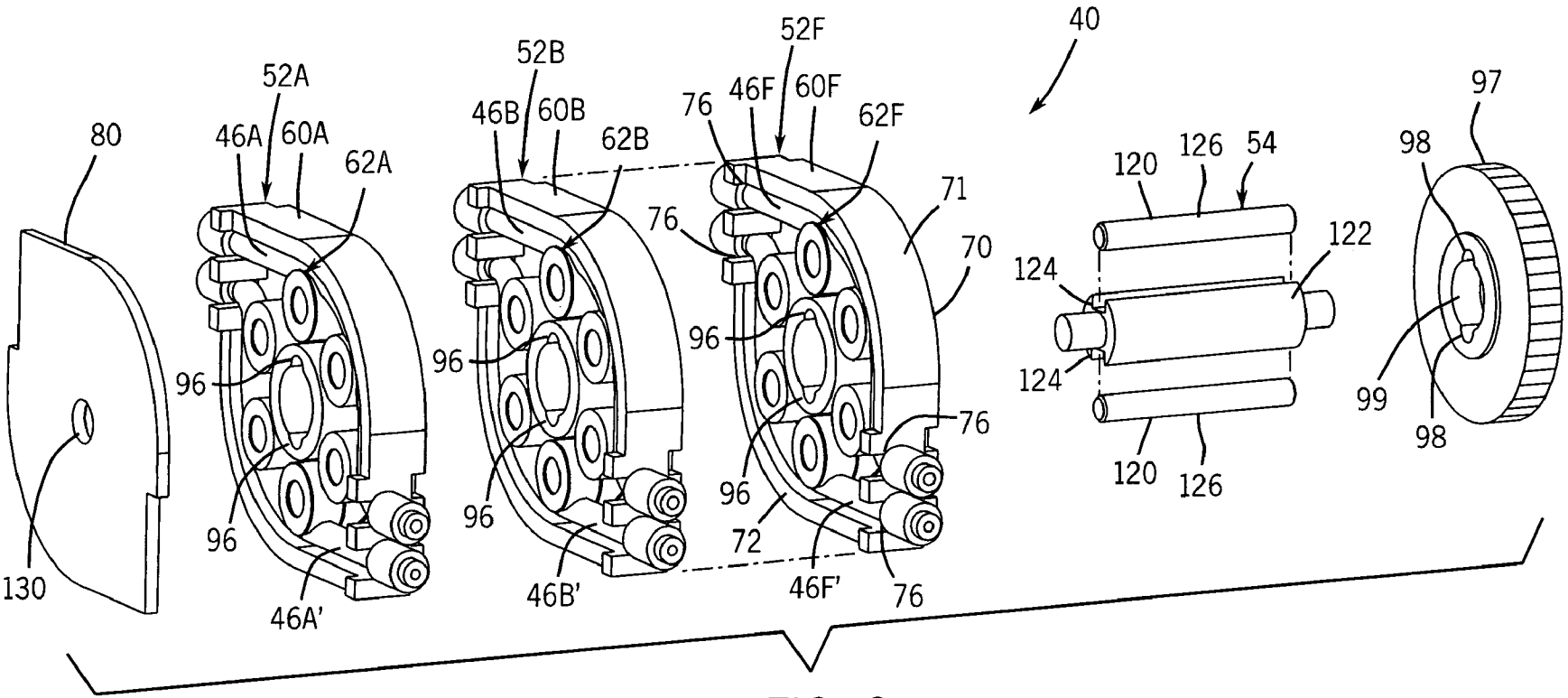
FIG. 3 is an exploded perspective view of portions of the pump shown in FIG. 2 according to an exemplary embodiment.
Figure 4:
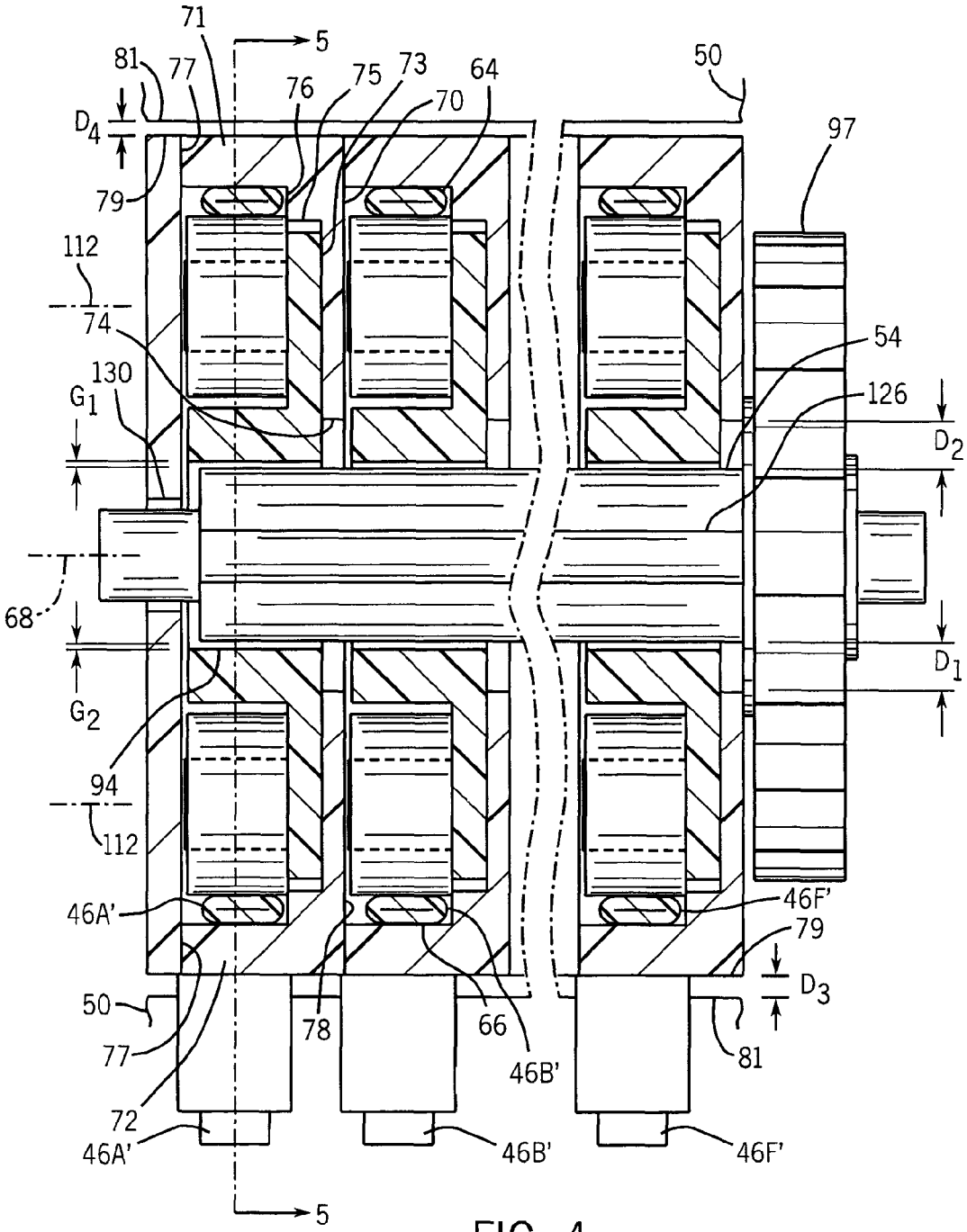
FIG. 4 is a sectional view of the pump of FIG. 2 according to an exemplary embodiment.
Figure 5:
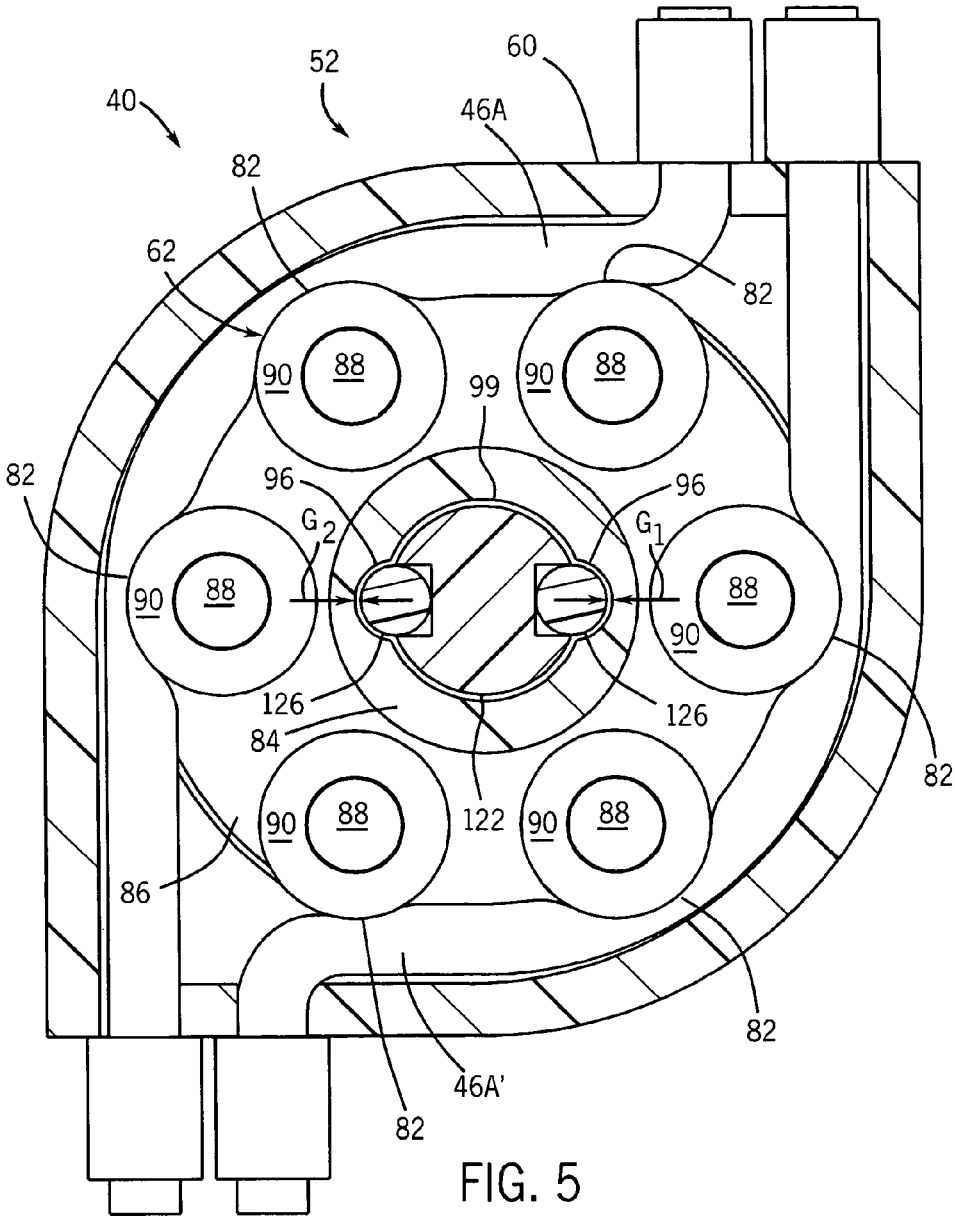
FIG. 5 is a sectional view of the pump of FIG. 4 taken along line 5-5, according to an exemplary embodiment.

FIGS. 3 and 4 illustrate pump units 52A-52F and drive shaft 54 in greater detail. Pump units 52A-52F are substantially identical to one another. In this example, pump units 52A-52F include housings 60A-60F, tubes 46A-46F, tubes 46A'-46F' and rotors 62A-62F, respectively. Housings 60A-60F comprise one or more structures configured to provide at least one occlusion surface against which tubes 46A-46F and tubes 46A'-46F' may be compressed. In the particular example shown in FIGS. 3 and 4, each housing 60A-60F provides two occlusion surfaces, occlusion surface 64 and occlusion surface 66. Occlusion surfaces 64 and 66 arcuately extend about axis 68 and generally face one another. Occlusion surfaces 64 and 66 cooperate with rotors 62A-62F to compress tubes 46A-46F or tubes 46A'-46F'.

In the particular example shown, each housing 60A-60F includes a main wall 70 and rims 71, 72. Main wall 70 generally extends between rims 71 and 72 and includes rotor bearing surface 73 and drive shaft opening 74. Rotor bearing surface 73 functions as a surface for locating the associated rotor along axis 68. Surface 73 faces a direction parallel to axis 68.

Drive shaft opening 74 extends through wall 70 and is sized to allow drive shaft 54 to pass through opening 74 and into connection with the associated rotor 62. In the particular example, drive shaft opening 74 is radially spaced from outermost portions of drive shaft 54 so as to further enable wall 70 and the associated housing 60 to move or otherwise float relative to drive shaft 54 or the associated rotor 62 in a direction non-parallel to and nominally perpendicular to axis 68.

Rims 71 and 72 extend from wall 70 and from surface 73 in a direction along axis 68. Rims 71 and 72 include occlusion surfaces 64 and 66, respectively. In addition, rims 71 and 72 include rotor retaining surfaces 75, tube retaining surfaces 76 and stacking surfaces 77. Rotor retaining surfaces 75 extending from surface 70 and are configured to retain their associated rotors 62A-62F in a direction perpendicular to axis 68. As will be described in greater detail hereafter, rotor retaining surfaces 75 are sufficiently spaced from rotor 62A-62F so as to permit movement of rotor 62A-62F in directions non-parallel and nominally perpendicular to axis 68.

Tube retaining surfaces 76 generally extend between rotor retaining surfaces 75 and occlusion surfaces 64, 66. Tube retaining surfaces 76 are configured to retain tubes 46A-46F and tubes 46A'-46F' against movement in directions parallel to axis 68. In the particular example shown, tube retaining surfaces 76 extend perpendicular to axis 68. In other embodiments, tube retaining surfaces 76 may extend at other angles relative to axis 68. Moreover, in particular embodiments, rotor retaining surfaces 75 may be omitted.

Stacking surfaces 77 comprise those surfaces of each housing 60A-60F which are configured to abut a surface of an adjacent housing 60A-60F, enabling housings 60A-60F to be positioned end-to-end so as to form a stack of pump units 52A-52F. In the example shown in FIG. 4, stacking surfaces 77 abut and mate with rear surfaces 78 of wall 70 of an adjacent housing 62A-62F. As a result, a portion of wall 78, not in abutment with stacking surfaces 77, extends opposite to tube retaining surface 76 and functions as a second tube retaining surface. Tube retaining surfaces 76 and the opposite portion of rear surfaces 78 of the adjacent housings 62A-62F cooperate to retain tubes 46A-46F and tubes 46A'-46F' in a direction along axis 68 to facilitate compression of tubes 46A-46F and 46A'-46F' between rotors 62A-62F and the occlusion surfaces 64 and 66 provided by housings 60A-60F. Rear surfaces 78 further extend opposite to and across rotors 62B-62F to assist in retaining rotors 62B-62F in place in directions parallel to axis 68. The end most housing 60A and its end most rotor 62A do not face an adjacent housing. As a result, the stack of pump units 52A-52F additionally includes a retainer plate 80 which abuts stacking surfaces 77 of housing 60A and extends opposite to tube retaining surfaces 76 and opposite to rotor retaining surface 73 of housing 60A to capture and retain rotor 62A and tubes 46A, 46A in directions along axis 68. In the particular embodiment, housing 60A and retainer plate 80 are permitted to move relative to one another in directions perpendicular to axis 68. In other embodiments, retaining plate 80 may be omitted where an empty housing is positioned to housing 60A in lieu of plate 80 or where frame 50 (shown in FIG. 2) is configured to replace plate 80. In still other embodiments, gear 97 may be coupled to drive shaft 54 on an opposite end of drive shaft 54 adjacent to housing 60A so as to face surface 73 to capture and retain rotor 62A and tubes 46A, 46A' within housing 60A in lieu of plate 80.

In the particular example shown in FIGS. 3 and 4, each housing 60A-60F has a generally half-clamshell configuration and is integrally formed as a single unitary body out of one or more polymeric materials. In other embodiments, one or more of housings 60A-60F may alternatively be formed from several structures mounted, welded, bonded or fastened together and may be formed from other materials or combinations of materials. Although pump 40 is illustrated as including a stack of six pump units 52A-52F having six adjacent stacked housings 60A-60F, pump 40 may alternatively include a fewer or greater number of such stacked pump units or adjacent housings.

Overall, housing 60A-60F enables pump 40 to be produced and assembled in a more economical and simpler fashion. Because rear surface 78 of wall 70 of each housing functions as both a tube retaining surface and as a rotor retaining surface opposite surfaces 73 and 76 when stacked adjacent another housing 60A-60F, the need for a rotor retaining surface or a tube retaining surface on the adjacent housing 60A-60F is eliminated. As a result, the overall axial length of pump 40 along axis 68 is reduced while maintaining a number of pump units 52A-52F. In addition, because the need for a tube retaining surface and a rotor retaining surface opposite surfaces 73 and 76 is eliminated, each housing 60A-60F may be configured to have a half-clamshell overall shape such that all critical surfaces of the housing 60A-60F are located on a single side, simplifying and reducing the cost of molding (no slides are required) and machining (no secondary operations are required).

The half-clamshell shape further simplifies assembly by enabling tops down and rotation methods. In particular, rotor 62F may be placed within housing 60F and appropriately rotated as portions of the rotor are assembled with tubes 46F and 46F' in place. Upon completion of pump unit 52F, housing 60E may be placed or stacked on top of the completed pump unit 52F and rotor 62E and the partially assembled rotor 62E may be placed within housing 60E. Rotor 62E may be appropriately rotated as its assembly is completed with tubes 46E and 46E' in place. This overall process is repeated as necessary depending upon the number of pump units provided by pump 40.

Tubes 46A-46F and 46A'-46F' comprise elongated conduits having wall portions that are resiliently flexible, permitting tubes 46A-46F and 46A'-46F' to be occluded by rotors 62A-62F to move fluid through tubes 46A-46F and 46A'-46F'. Tubes 46A-46F and 46A'-46F' extend between rotors 62A-62F and occlusion surfaces 64 and 66, respectively. Tubes 46A-46F and 46A'-46F' each generally has an internal cross sectional diameter smaller than the internal cross sectional diameter of conduits 42 and 44 to achieve higher fluid pumping rates. In the embodiment shown, tubes 46A-46F deliver fluid to a dispensing device 28 (shown in FIG. 1) while tubes 46A'-46F' return fluid from the fluid dispensing device 28. Tubes 46A-46F have a smaller cross sectional diameter than the cross sectional diameter of tubes 46A'-46F'. In other embodiments, tubes 46A-46F and 46A'-46F' may have equal cross sectional diameters. Although tubes 46A-46F and 46A'-46F' are illustrated as having a generally circular cross sectional shape, tubes 46A-46F and 46A'-46F' may have other alternative cross sectional shapes, wherein at least a portion of the tube is flexible.

In the embodiment shown, tubes 46A-46F and 46A'-46F' are formed from one or more polymeric materials. Tubes 46A-46F and 46A'-46F' may be formed from a single layer or multiple layers. Tubes 46A-46F, 46A'-46F' may be homogenous in nature or may be formed from a plurality of mixed materials. One example of a material from which tubes 46A-46F and 46A'-46F' may be formed is SANTOPRENE thermoplastic elastomer which is currently sold by Advanced Elastomers, Inc. Although tubes 46A-46F and 46A'-46F' are illustrated as being formed of common materials, tubes 46A-46F and 46A'-46F' may alternatively be formed from different materials as compared to one another.

Rotors 62A-62F comprise one or more structures providing occluding surfaces that are moved against tubes 46A-46F and tubes 46A'-46F' while at least partially occluding tubes 46A-46F and 46A'-46F' to move fluid therethrough. In the particular examples shown in FIGS. 3-5, each rotor 62A-62F includes a set of six occluding surfaces 82 that compress and at least partially occlude tubes 46A-46F and tubes 46A'-46F' while rotating about axis 68. Each rotor 62A-62F is generally located between occlusion surfaces 64 and 66 of housing 60A-60F, respectively, such that fluid is moved or pumped through tubes 46A-46F and tubes 46A'-46F' simultaneously.

Each rotor 62A-62F generally includes hub 84, post support 86, posts 88 and rollers 90. Hub 84 couples each of post support 86, posts 88 and rollers 90 to one another about axis 68, enabling rollers 90 to be simultaneously rotated about axis 68. Hub 84 couples the remainder of its respective rotor 62A-62F to drive shaft 54. In the particular embodiment shown, hub 84 additionally includes two opposite detents 96 extending along bore 94. Detents 96 are configured to receive corresponding projections 120 of drive shaft 54.

Post support 86 radially extend from hub 84 and support posts 88. Posts 88 extend from post support 86 and rotatably support rollers 90 about axes 112. Because posts 88 extend from a single side of post support 86, substantially all of the critical surfaces of each rotor 62A-62F are located on a single side, simplifying and reducing the cost of molding and machining. In other embodiments, rotors 62A-62F may have alternative configurations. Although each of rotors 62A-62F are illustrated as including six posts 88 and six rollers 90, rotors 62A-62F may alternatively include a greater or fewer number of such components. Although post supports 86 are illustrated as generally annular members extending about hubs 84, supports 86 may alternatively comprise individual arms radially projecting from hub 84.

Rollers 90 are rotatably supported by posts 88 and provide occluding surfaces 82. Rollers 90 generally comprise annular rings rotatably supported about axes 112 such that rollers 90 roll against tubes 46A-46F and tubes 46A'-46F' as rotors 62A-62F are rotatably driven about axis 68. In other embodiments, occluding surfaces 82 may be provided by other structures rotatably or stationarily coupled to the remainder of rotors 62A-62F. According to one embodiment, rollers 90 are injection molded. Because of their relatively short axial length, less than about 6 millimeters each, rollers 90 may be injection molded from a single side, reducing cost while minimizing dimensional variations. In other embodiments, rollers 90 may be formed using other techniques such as extrusion, blow-molding and the like. Although rotors 62A-62F are illustrated as including six equiangularly spaced sets of posts 88 and rollers 90 about hub 84, rotors 62A-62F may alternatively include a greater or fewer number of such sets of posts 88 and rollers 90.

Drive shaft 54 rotatably drives rotor 62A-62F. Drive shaft 54 is operably coupled to a source of rotational power or torque (schematically shown), such as a motor. In the particular example shown, drive shaft 54 is coupled to a gear 97 which is in meshing engagement with a remaining portion of a drive train rotatably driven by the torque source 318 (shown in FIG. 2).

In the particular embodiment shown, drive shaft 54 includes two opposite projections 120 which radially extend from drive shaft 54 and which are configured to be received within detents 96 of rotors 62A-62F. Projections 120 further extend into corresponding detents 98 formed along a central bore 99 of gear 97. In the particular example shown, drive shaft 54 includes a main pin 122 having a pair of opposite axial grooves 124 which removably receive engagement pins 126 which provide projections 120.

In other embodiments, drive shaft 54 may have a variety of alternative configurations. For example, in lieu of projections 120 being provided by pins 126 removably received within channels 124 of pin 122, projections 120 may alternatively be integrally formed as a single unitary body with a remainder of drive shaft 54. Although drive shaft 54 is illustrated as having a pair of opposite projections 120, drive shaft 54 may alternatively have a greater or lesser number of such projections which are received within a corresponding number of detents formed within hub 84 of rotors 62A-62F. In particular embodiments, drive shaft 54 may include a multitude of splines or may have other non-circular cross sectional shapes such that rotation of drive shaft 54 further results in rotation of rotors 62A-62F.

In the particular embodiment illustrated, drive shaft 54 and hub 84 of each of rotors 62A-62F are configured to enable each rotor 62A-62F to move or float relative to drive shaft 54 and relative to axis 68 in directions non-parallel to and nominally perpendicular to axis 68. At the same time, drive shaft 54 and hub 84 of each of rotors 62A-62F are configured such that rotation of drive shaft 54 rotatably drives rotors 62A-62F about axis 68. As shown by FIG. 4, the exterior periphery of drive shaft 54 about axis 68 is radially spaced from the corresponding interior surfaces of bore 94 and detents 96 of hub 84 by opposite gaps G1 and G2 which, when combined, provide a diametral spacing $S_1$. The diametral spacing is large enough to allow sufficient movement of each rotor 62A-62F relative to axis 68 and relative to drive shaft 54 to enable each rotor 62A-62F to automatically center itself between tubes 46A-46F and tubes 46A'-46F', respectively, in response to opposing tube reaction forces resulting from opposing tube compressions. Because each rotor 62A-62F is self-centering, any dimensional variations which may otherwise result in over-occlusion of one of tubes 46A-46F and under-occlusion of the opposite tube 46A'-46F' are evenly shared between both tubes of each pump unit 52A-52F. Because dimensional errors or tolerances are shared across both tubes 46A-46F and 46A'-46F' in each of pump units 52A-52F, the torque required to rotatably drive each rotor 62A-62F is reduced. The self-centering nature of rotors 62A-62F further enables different tube sizes with somewhat similar force and flexion points to be accommodated. In the particular embodiment shown, the diametral spacing $S_1$ is at least about 0.4 millimeters and nominally at least about 0.6 millimeters.

As further shown by FIG. 4, surfaces 74 of each of housings 60A-60F are spaced from the exterior most peripheral surfaces of drive shaft 54 while being permitted to independently move relative to adjacent housing 60A-60F. In particular, surfaces 74 are radially spaced from the exterior most surfaces of projections 120 (and from main pin 122 by distances $D_1$ and $D_2$) to form a diametral spacing $S_2$ between projections 120 and surfaces 74. In addition, opposite exterior surfaces 79 of each of housings 60A-60F are spaced from opposite surfaces 81 of frame 50 by distances $D_3$ and $D_4$ which together form a diametral spacing $S_3$. The smaller of $S_2$ and $S_3$ may limit movement of each housing 60A-60F. As a result of these clearances, each housing 60A-60F is permitted to move or float relative to axis 68 and relative to drive shaft 54 in directions non-parallel to and nominally perpendicular to axis 68. Consequently, each of housings 60A-60F automatically repositions itself and its occlusion surfaces 64, 66 using the compression reaction forces of tubes 46A-46F and tubes 46A'-46F' to appropriately center itself, automatically taking into account the differences between tubes 46A-46F and tubes 46A'-46F' as well as dimensional variations which may otherwise result in over compression of one of tubes 46A-46F and under compression of the other of tubes 46A'-46F'. In the particular example shown, the smallest of diametral spacings $S_2$ and $S_3$ is at least 0.2 millimeters and is nominally at least 0.45 millimeters. In one embodiment, the sum of $S_1$ and the smallest of $S_2$ and $S_3$ is at least 0.6 millimeters.

According to one embodiment, each housing 60A-60F and its corresponding rotor 62A-62F have a combined total clearance ($S_1$+(smallest of $S_2$ and $S_3$)) of at least 2.0% $D_{mean}$, wherein $D_{mean}$ is equal to one-half the sum of the inside diameter of the particular housing 60A-60F (the radial distance between opposite occlusion surfaces 66) and the outside diameter of the corresponding rotor 62A-62F (the diameter of the smallest circle which is tangent to and encompassing the outer occluding surfaces of the rotor 62A-62F, i.e., the radial spacing between 2 opposite occluding surfaces 82). In one particular embodiment, the inside diameter of the housing is 32.5 millimeters, the outside diameter of the rotor is 30.5 millimeters, and the mean diameter ($D_{mean}$) is 31.5 millimeters. In such an embodiment, the sum of the clearances $S_1$ and the smallest of $S_2$ and $S_3$ is greater than or equal to 2.0% of 31.5 millimeters or 0.63 millimeters. In other embodiments, the sum of the clearances $S_1$ and the smallest of $S_2$ and $S_3$ may be increased or decreased depending upon the inside diameter of the housing and the outside diameter of the rotor.

Overall, pump 40 provides a mechanism for pumping fluid through a multitude of tubes that is less susceptible to tolerance or dimensional variations and that is less costly and complex. One or both of housings 60A-60F or rotors 62A-62F automatically center themselves between opposing tubes 46A-46F and 46A'-46F' using tube compressive reaction forces. As a result, fluid pumping efficacy and its torque requirements are reduced as the potential for overly compressing or under compressing tubes 46A-46F and tubes 46A'-46F' is reduced. In addition, because pump units 52A-52F are interchangeable with one another and may be stacked, tube occlusion forces are not transferred between pumping units, pump 40 is more compact, housings 60A-60F are more easily manufactured and rotors 62A-62F are more easily assembled within housings 60A-60F. Because pump units 52A-52F are substantially identical to one another, pump units 52A-52F may be used in a variety of different pumps having differing numbers of pump units without requiring substantial additional engineering or part modification.

Although the particular example illustrates the combination of many features which provide the aforementioned benefits in conjunction with one another, such features may alternatively be used independent of one another in other pumps. For example, in other embodiments, one or more rotors 62A-62F may be configured to move or otherwise float relative to axis 68 within a housing providing occlusion surfaces for multiple rotors or within multiple housings which remain substantially relative to axis 68 as rotors 62A-62F are being rotated. The individual housings 60A-60F of pump units 52A-52F, which float relative to axis 68, may alternatively be utilized with rotors 62A-62F which are configured to remain substantially stationary relative to axis 68 as they are being rotated between tubes 46A-46F and tubes 46A'-46F'. In particular embodiments, each pump unit 52A-52F may be provided with a dedicated retainer plate 80 in lieu of the pump units 52A-52F utilizing the back side of an adjacent pump unit 52A-52F.

FIGS. 6-15 illustrate pump 240, another embodiment of pump 40. Pump 240 is similar to pump 40 in that pump 240 includes a plurality of pump units 52A-52F positioned with the frame 50 as shown in FIG. 2. However, each pump unit 52A-52F includes an alternatively configured housing, an alternatively configured rotor and is driven by an alternatively configured drive shaft. In the particular embodiment shown in FIGS. 6-15, pump 240 is similar to pump 40 in that pump 240 accommodates dimensional variations by permitting its housings and rotor to float relative to the drive shaft and is formed as a stack. In addition, as described in detail below, pump 240 reduces torque requirements by utilizing sets of occluding surfaces having a staggered pitch and by configuring its rotors and housings to flex to accommodate dimensional variations to minimize or prevent over compression or under compression of its tubes.

Figure 6:
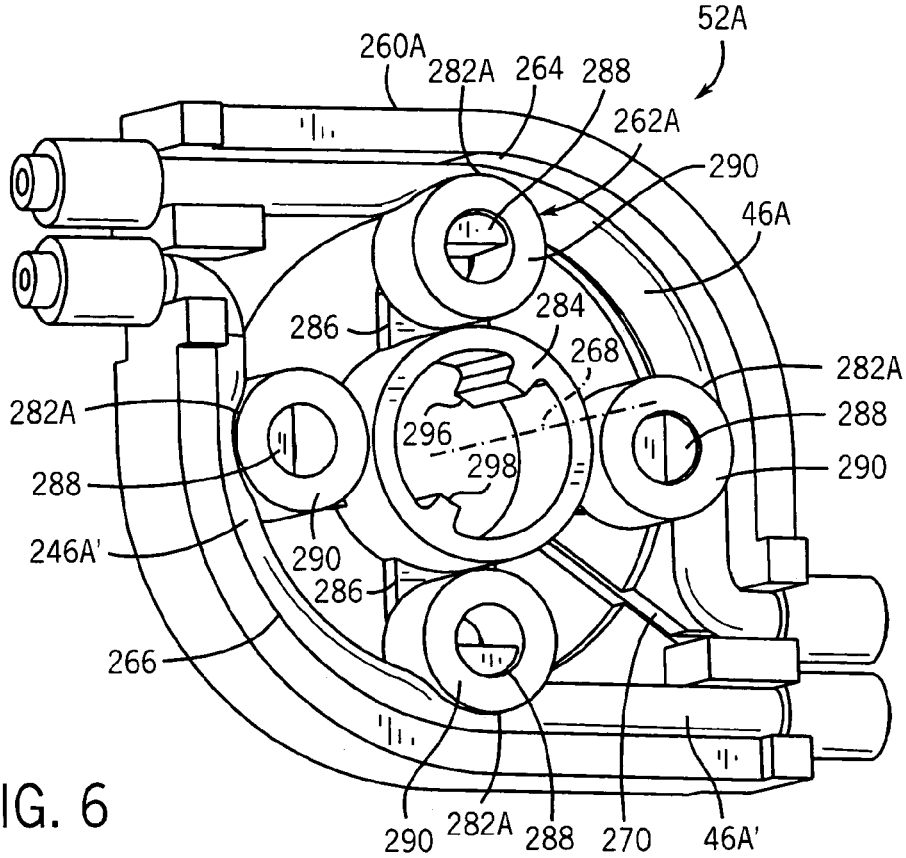
FIG. 6 is a perspective view of another embodiment of a pumping unit of the peristaltic pump of FIG. 2, according to an exemplary embodiment.
Figure 7:
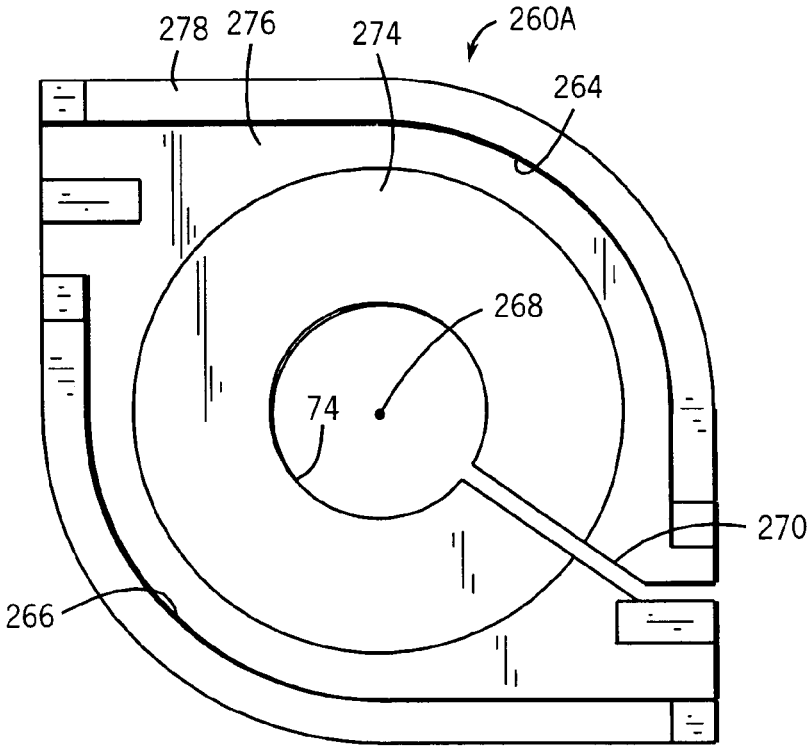
FIG. 7 is a side elevational view of a housing of the pumping unit of FIG. 6, according to an exemplary embodiment.

FIG. 6 illustrates a single pump unit 52A of pump 240 in greater detail. The remaining units 52B-52F of pump 240 are substantially identical to unit 52A. As shown by FIG. 6, unit 52A generally includes housing 260A, tubes 46A, 46A' and rotor 262A. Housing 260A comprises one or more structures configured to provide at least one occlusion surface against which a tube 46A may be compressed. In the particular example shown in FIG. 3, housing 260A provides two occlusion surfaces, occlusion surface 264 and occlusion surface 266. As shown by FIG. 7 which illustrates housing 260A in greater detail, occlusion surfaces 264 and 266 each arcuately extend about axis 268 and generally face one another. Occlusion surfaces 264 and 266 are configured to resiliently flex away from one another and substantially away from axis 268. As a result, occlusion surfaces 264 and 266 automatically account for or adapt to manufacturing variation or tolerances associated with the various components of pump 240 including housing 260A, tubes 46A, 46A' and rotor 262A. By accommodating component parts' dimensional variations, occlusion surfaces 264 and 266 facilitate the proper amount of compression of tubes 46A and 46A'. In particular, tubes 46A and 46A' are not undercompressed which results in fluid not being consistently pumped. At the same time, tubes 46A and 46A' are not overly compressed or occluded which requires increased torque or power to rotate rotor 262A and which reduces the useful life of tubes 46A and 46A'.

In the particular example shown in FIG. 7, housing 260A includes a separation slit 270 extending between surfaces 264 and 266. Slit 270 provides housing 260A with a continuous opening or passage radially extending from an exterior of housing 260A to axis 268. Slit 270 in conjunction with the materials and dimensions of housing 260A facilitate flexing of occlusion surfaces 264 and 266 away from one another and away from axis 268. In the particular example shown in FIG. 7, occlusion surfaces 264 and 266 are integrally formed as a single unitary body with appropriate dimensions and formed from appropriate materials enabling portions of housing 260A to resiliently flex as a living hinge. Because occlusion surfaces 264 and 266 of housing 260A are integrally formed as a single unitary body, housing 260A increases the overall flexibility and compliance of pump unit 252A without requiring additional parts or springs. As a result, manufacturing and assembly complexity and costs are reduced.

According to one embodiment, the ability of housing 260A to flex away from slit 270 (i.e. its spring rate or spring constant) is no greater than about eight times the spring constant of a fully compressed tubes 46A, 46A' at the beginning of occlusion and is no greater than four times the spring constant of a fully compressed tube 46A or 46A' at the maximum occlusion or compression of tube 46A or 46A'. In one particular embodiment, tube 46A has a diameter of approximately 3.0 millimeters and a nominal wall thickness of approximately 0.75 millimeters. Tube 46A' has a diameter slightly smaller than 3.0 millimeters and a nominal wall thickness of about 0.75 millimeters. Tubes 46A and 46A' are each generally collapsed at a tube compression of about 1.5 millimeters (a height of 2 times the wall thickness). The range of desired tube compression is generally between 1.6 millimeters and 1.9 millimeters. In such an embodiment, the ratio of spring rates between the housing 260A and both tubes 46A, 46A' (Kh/Kt) varies from no greater than about eight at the beginning of occlusion (1.6 millimeter compression) and decreases to no greater than about four at the high end of desired tube occlusion (1.9 millimeters).

In the particular embodiment shown, housing 260A additionally accommodates dimensional variations by automatically floating or moving relative to rotor 262A and drive shaft 254 in directions non-parallel to and nominally perpendicular to axis 268. Similar to housings 60A-60F described above, housing 260A includes drive shaft opening 74 which is sized to allow drive shaft 254 to pass through opening 74 in connection with the associated rotor 262A. Drive shaft opening 74 is radially spaced from outer most portions of drive shaft 254 so as to enable housing 260A to move or otherwise float relative to drive shaft 254 or the associated rotor 262A in a direction non-parallel to and nominally perpendicular to axis 268. In other embodiments, housing 260A may alternatively be configured so as to be held stationary relative to axis 268.

In the particular example shown in FIG. 7, housing 260A is molded out of a polymeric material such as polycarbonate. Housing 260A has wall thicknesses 1 mm, 2.5 and 2.3 mm at locations 274, 276 and 278, respectively. Slit 270 has a width of about 1 mm.

In other embodiments, housing 260A may have various other configurations, may be made from one or more alternative materials and may have other dimensions while still permitting occlusion surfaces 264 and 266 to flex away from one another and away from axis 268. In other embodiments, housing 260A may be formed from two or more structures that are coupled to one another while permitting surfaces 264 and 266 to flex away from one another. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. In still other embodiments, housing 260A may alternatively include two or more structures coupled to one another by a mechanical spring opposite slit 270 or may include two or more structures coupled to one another by multiple springs, eliminating slit 270 yet enabling surfaces 264 and 266 to flex away from one another.

Rotor 262A generally comprises one or more structures providing occluding surfaces that are moved against tubes 46A and 46A' while at least partially occluding tubes 46A and 46A' to move fluid therethrough. In the particular example shown in FIG. 6, rotor 262A includes a set of four occluding surfaces 282A that compress and at least partially occlude tubes 46A and 46A' while rotating about axis 268. Rotor 262A is located between occlusion surfaces 264 and 266 such that fluid is moved or pumped through tubes 46A and 46A' simultaneously.

Figure 8:
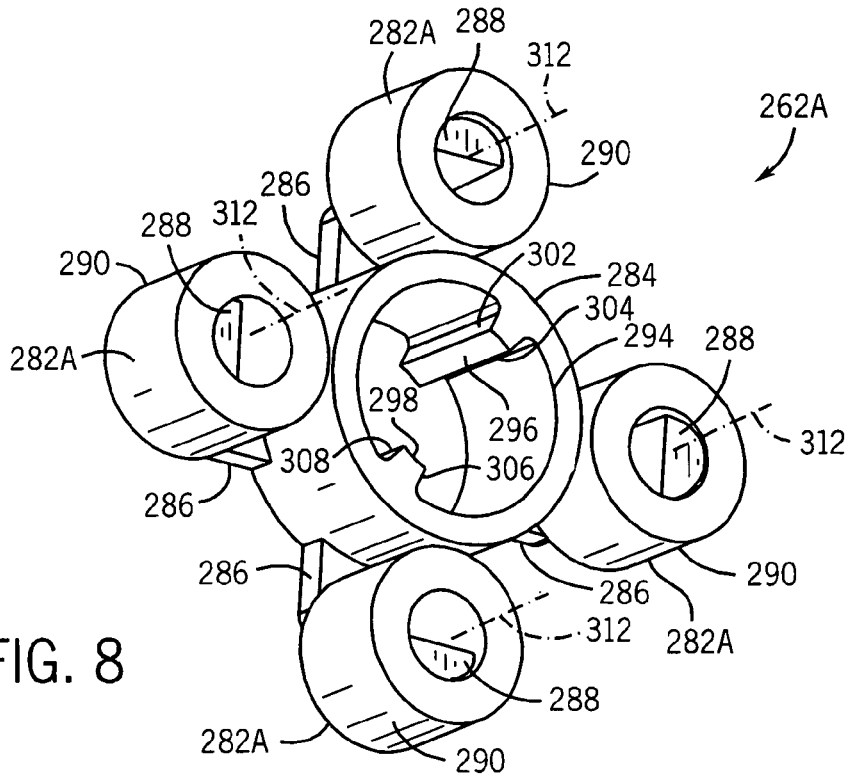
FIG. 8 is a perspective view of a rotor of the pumping unit of FIG. 2, according to an exemplary embodiment.
Figure 9:
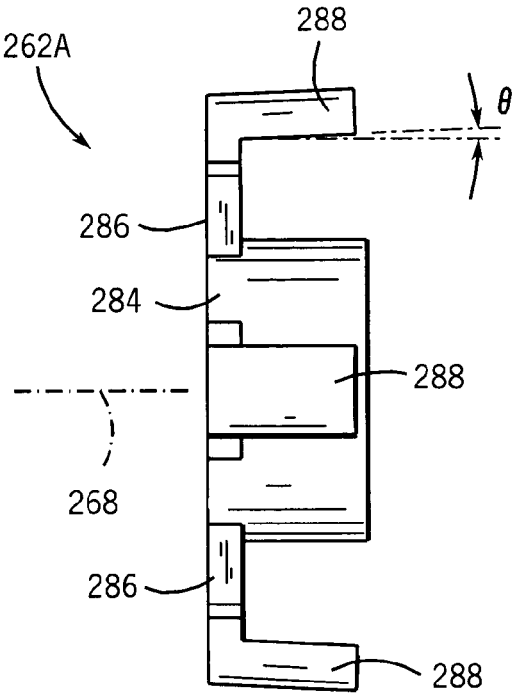
FIG. 9 is a side elevational view of the rotor of FIG. 8 with portions omitted for purposes of illustration, according to an exemplary embodiment.

FIGS. 8 and 9 illustrate rotor 262A in greater detail. As shown by FIGS. 8 and 9, rotor 262A includes hub 284, arms 286, posts 288 and rollers 290. Hub 284 couples each of arms 286, posts 288 and rollers 290 to one another about axis 268, enabling rollers 290 to be simultaneously rotated about axis 268. Hub 284 couples the remainder of rotor 262A to drive shaft 254 (shown in FIG. 10). In the particular example shown, hub 284 includes central bore 294 and projections 296, 298. Bore 294 extends through hub 284 and is configured to receive drive shaft 254 (shown in FIG. 10) such that drive shaft 254 may rotate relative to hub 284. Although bore 294 is illustrated as having a generally circular cross sectional shape, bore 294 may have other cross sectional shapes.

Projections 296 and 298 extend inwardly from bore 294 and are configured to engage portions of drive shaft 254, enabling drive shaft 254 to transmit torque to rotor 262A. In the example shown, projection 296 includes circumferentially spaced engagement surfaces 302, 304. Projection 298 includes circumferentially spaced engagement surfaces 306, 308. As will be described in greater detail hereafter, engagement surfaces 302, 304, 306 and 308 are engaged by drive shaft 254, depending upon the direction in which drive shaft 254 is being rotatably driven, to rotate rotor 262A between a staggered pitch and an off pitch. Although projections 296 and 298 are illustrated as elongate teeth extending along the entire axial length of hub 284, projections 296 and 298 may extend only partially along the axial length of hub 284 and may have various other configurations. In other embodiments, hub 284 may include a greater or fewer number of such projections. In still other embodiments, hub 284 may include one or more grooves which receive projections of drive shaft 254.

In the particular embodiment illustrated, projections 296 and 298 as well as the inner surfaces of bore 294 are radially spaced from opposite surfaces of drive shaft 254 so as to enable rotor 262A to move or float relative to drive shaft 254 and relative to axis 268 in directions non-parallel to nominally perpendicular to axis 268. The diametral spacing between projections 296, 298 and bore 294 and the opposing surfaces of drive shaft 254 is large enough to enable rotor 262A to automatically center itself between tube 46A and 46A' in response to opposing tube reaction forces resulting from opposing tube compressions. In the particular embodiment shown, the diametral spacing is at least about 0.4 millimeters and nominally at least 0.6 millimeters. In other embodiments, projections 296, 298, bore 294 and drive shaft 254 may alternatively be configured to prevent movement of rotor 262A relative to axis 268.

Arms 286 radially extend from hub 284 and support posts 288. Posts 288 extend from arms 286 and rotatably support rollers 290 about axes 312. Posts 288 nonsymmetrically extend about axes 312 and have a generally non-circular or non-annular cross sectional shape. Posts 288 are further formed from one or more materials which enable posts 288 to deflect or flex towards axis 268. In the particular embodiment illustrated, each post 288 has a generally semi-cylindrical shape. As shown by FIG. 9, to further facilitate inward flexing of posts 288, posts 288 obliquely extend from arms 286 in an unflexed state away from axis 268. Because posts 288 are resiliently compliant in a direction towards axis 268, rollers 290 are also resiliently compliant in a direction towards axis 268. As a result, posts 288 and rollers 290 accommodate dimensional variations resulting from the manufacture or assembly of pump 240. As a result, there is less likelihood that tubes 46A and 46A' will be undercompressed or over compressed.

In the particular embodiment illustrated, post 288 are configured so as to be resiliently compliant with a spring constant of no greater than six times a spring constant of fully compressed tubes 46A, 46A'. According to one embodiment, tube 46A has a diameter of about 3.0 millimeters and a wall thickness of approximately 0.75 millimeters. Tube 46A' has a diameter less than 3.0 millimeters and a wall thickness of about 0.75 millimeters. Tubes 46A and 46A' each have a range of desired tube compression of between 1.6 millimeters and 1.9 millimeters. Tubes 46A and 46A' are generally collapsed at a tube compression of 1.5 millimeters (height of 2 times the wall thickness). In such an embodiment, posts 288 generally have a nonlinear spring constant. Tubes 46A and 46A' also experience a nonlinear spring constant or compliance. The ratio of spring rates between the rotor provided by an arm 286 and its corresponding post 288 to the spring rate of tubes 46A and 46A' varies from approximately six at the beginning of occlusion (1.6 millimeters) and decreases to approximately four at the high end of the desired tube occlusion (1.9 millimeters). Overall, at the low end of desired tube occlusion (1.6 millimeters of compression) 77% of any additional compression is taken up by tube 46A while 23% is taken up by housing 60A or by the combination of housing 60A and rotor 262A. At the high end of desired tube occlusion (1.9 millimeters), 64% of additional compression is taken up by tube 46A while 36% is taken up by the combination of housing 260A and rotor 262A. In particular embodiments, the spring constant of post 288 may be modified depending upon other factors such as the spring constant of housing 260A.

Because the overall compliance of rotor 262A is achieved by integrating compliance into the design of the existing rotor 262A, the improved performance of rotor 262*a* is achieved without requiring additional parts or springs. Consequently, unit 252A is more compact and has reduced complexity, manufacturing costs and assembly costs.

In the examples shown in FIGS. 8 and 9, each of posts 288 obliquely extends from its respective arm 286 at an angle θ of about 2.5 degrees. Hub 284, arms 286 and posts 288 are integrally formed as a single unitary body out of a polymeric material such as 20% glass filled polycarbonate. Each of arms 286 has a radial length from a center of hub 284 of about 13 mm, a circumferential width of about 6 mm and axial thickness of about 1.5 mm. Each of posts 288 has an axial length extending from arms 286 of about 5 mm and a diameter of about 4 mm.

In other embodiments, one or more of hub 284, arms 286 and posts 288 may be separately formed and coupled to one another in other fashions. Hub 284, arms 286 and posts 288 may be formed from one or more alternative polymeric or other materials. In addition, arms 286 and posts 288 may have different dimensions, different shapes and may extend at different angles relative to one another while enabling posts 288 to resiliently flex towards axis 268.

As shown by FIG. 8, rollers 290 are rotatably supported by posts 288 and provide occluding surfaces 282A. Rollers 290 generally comprise annular rings rotatably supported about axes 312 such that rollers 290 roll against tubes 46A and 46A' as rotor 262A is rotatably driven about axis 268. In other embodiments, occluding surfaces 282A may be provided by other structures rotatably or stationarily coupled to the remainder of rotor 262A. Although rotor 262A is illustrated as including four equiangularly spaced sets of arms 286, posts 288 and rollers 290 about hub 284, rotor 262A may alternatively include a greater or fewer number of such sets of arms 286, posts 288 and rollers 290.

Figure 10:
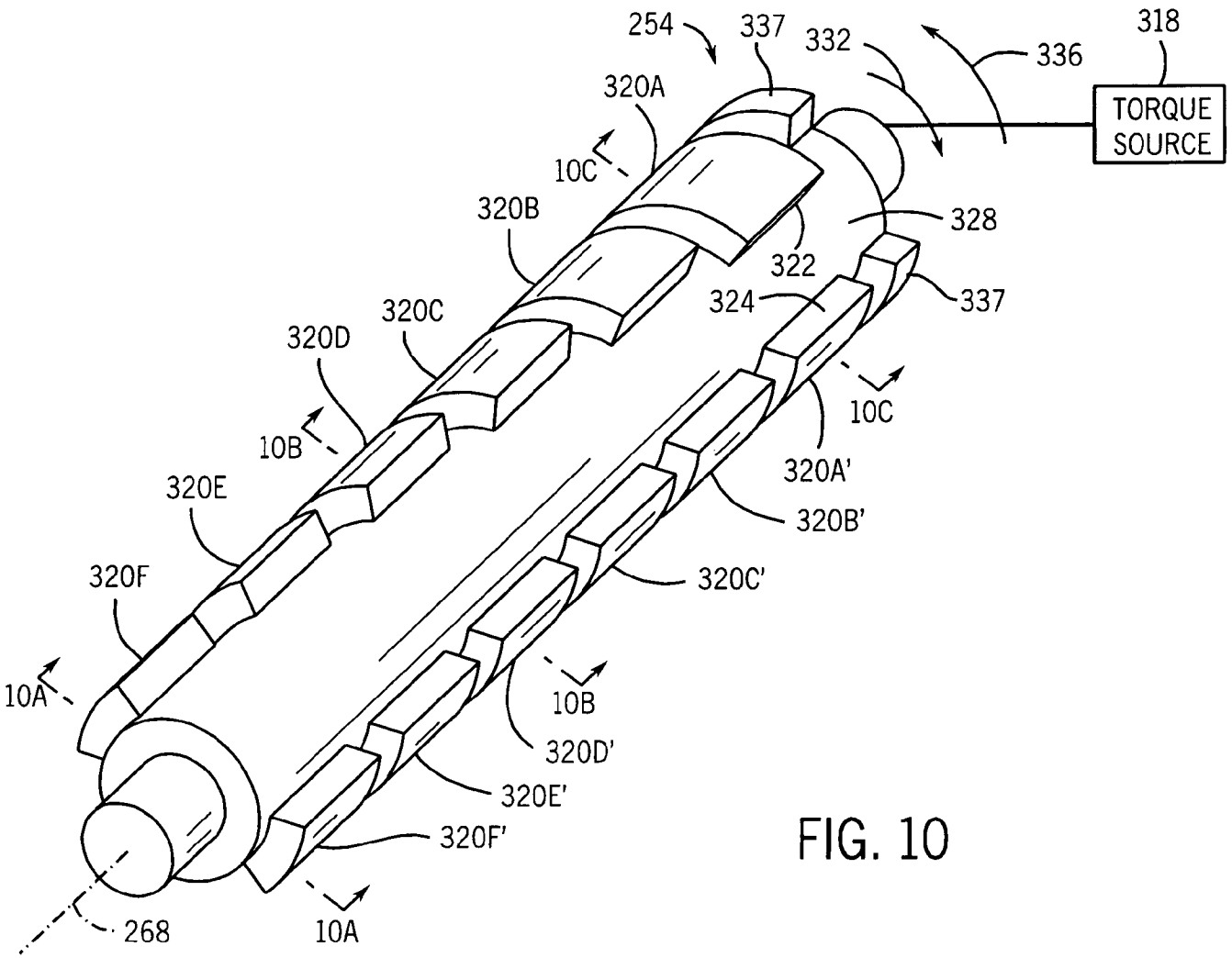
FIG. 10 is a perspective view of a drive shaft of the pump of FIG. 2 coupled to a torque source, according to an exemplary embodiment.
Figure 10A:
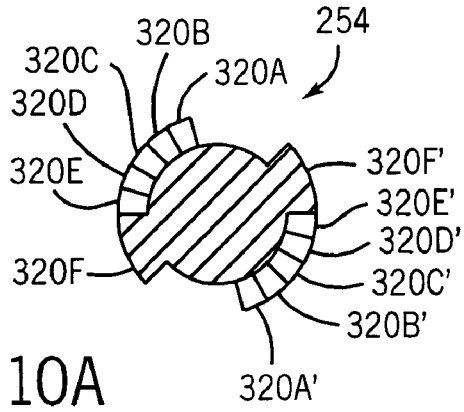
FIG. 10A is a sectional view of the drive shaft of FIG. 10 taken along line 10A-10A, according to an exemplary embodiment.
Figure 10B:
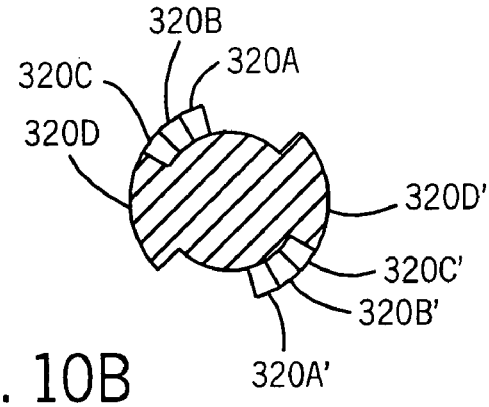
FIG. 10B is a sectional view of the drive shaft of FIG. 10 taken along line 10B-10B, according to an exemplary embodiment.
Figure 10C:
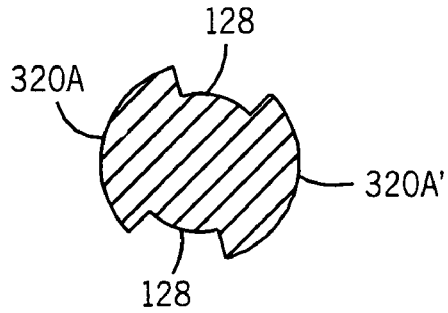
FIG. 10C is a sectional view of the drive shaft of FIG. 10 taken along line 10C-10C, according to an exemplary embodiment.

Drive shaft 254 is shown in FIGS. 10, 10A, 10B and 10C. Drive shaft 254 rotatably drives rotors 262A as well as rotors 262B-262F (shown in FIGS. 8 and 9) of pump units 52A-52F (shown in FIG. 2). Drive shaft 254 is operably coupled to a source of rotational power or torque 318 (schematically shown), such as a motor. Drive shaft 254 includes rotor interfaces 320A, 320A', 320B, 320B', 320C, 320C', 320D, 320D', 320E, 320E', 320F and 320F'. Each of interfaces 320A-320F and 320A'-320F' includes a drive surface 322 and a drive surface 324. Drive surfaces 322 and 324 of each interface 320A-320F and 320A'-320F' are circumferentially spaced from one another and generally face in opposite directions. Drive surfaces 322 and 324 of axially aligned interfaces, such as interfaces 320A and 320A', generally face one another and are separated by an opening or channel 328 through which projections 296 and 298 (shown in FIG. 8) extend and move. As shown by FIGS. 10, 10A and 10B, drive surfaces 322 of each of interfaces 320A-320F are angularly offset from one another or have a first staggered pitch. As shown by FIGS. 10A and 10B, drive surfaces 322 of interfaces 320A'-320F' are angularly offset from one another and have a first staggered pitch. As further shown by FIGS. 10A, 10B and 10C, drive surfaces 322 of interfaces 320A-320F are circumferentially spaced from drive surfaces 322 of interfaces 320A'-320F', respectively, by 180 degrees.

As shown by FIGS. 10A and 10B, drive surfaces 324 of interfaces 320A-320F are angularly or circumferentially positioned relative to one another so as to have a second off pitch. For purposes of this disclosure, the term "off pitch" means any pitch or angular relationship between set of drive surfaces 324 of interfaces 320A-320F or 320A'-320F' that is distinct from the first relative angular positioning or pitch of the set of drive surfaces 322 of interfaces 320A-320F or 320A'-320F'. In those applications in which drive shaft 254 includes only a single set of interfaces, such as interfaces 320A-320F, the term "off pitch" means that the second angular spacing or pitch between drive surfaces 324 is distinct from the first angular spacing or staggered pitch of drive surfaces 322 of the same set of interfaces.

In the particular example shown in FIGS. 10, 10A, 10B and 10C, drive surfaces 324 of interfaces 320A-320F have an off pitch wherein drive surfaces 324 of each of interfaces 320A-320F are angularly aligned with one another. Similarly, drive surfaces 324 of each of interfaces 320A'-320F' have an off pitch wherein each of drive surfaces 324 of interfaces 320A'-320F' are also angularly aligned with one another. In other embodiments, drive surfaces 324 of interfaces 320A-320F, drive surfaces 324 of interfaces 320A'-320F' or drive surfaces 324 of both sets of interfaces may have an off pitch, wherein drive surfaces 324 have a second staggered pitch in which drive surfaces 324 are angularly offset from one another but with a distinct pitch or angular spacing as compared to drive surfaces 322.

Figure 11:
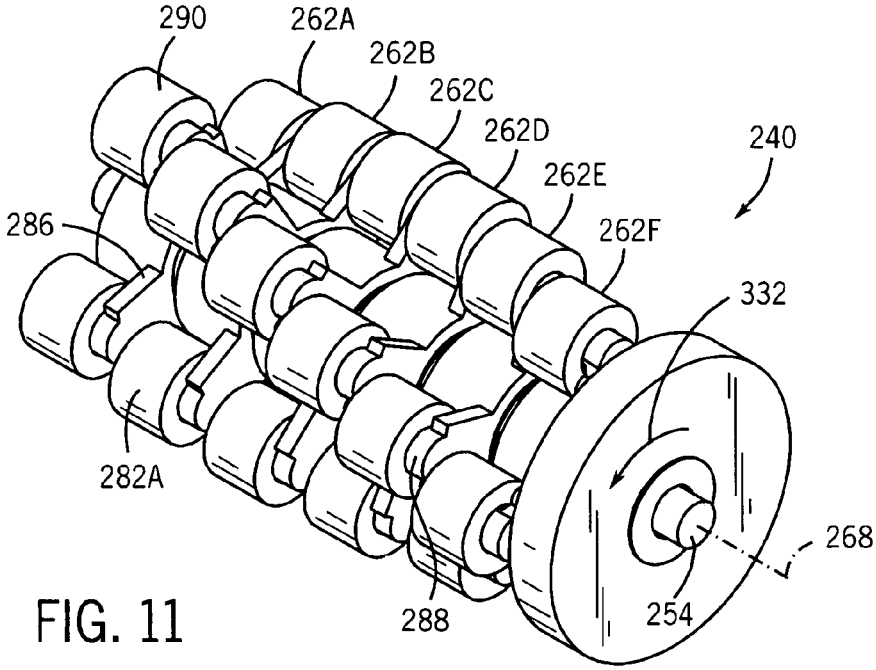
FIG. 11 is a perspective view of the rotors of the pump of FIG. 2 supported by the drive shaft of FIG. 10 with a staggered pitch, according to an exemplary embodiment.

In the particular example shown, drive surfaces 322 of each set of interfaces 320A-320F and 320A'-320F' have the first staggered pitch such that when drive shaft 254 is rotatably driven by torque source 318 in the direction indicated by arrow 332, drive surfaces 322 of interfaces 320A-320F contact and engage engagement surfaces 302 of hubs 284 of each of rotors 262A-262F (shown in FIG. 11). At the same time, drive surfaces 322 of each of interfaces 320A'-320F' contact and engage engagement surfaces 306 of hubs 284 of each of rotors 262A-262F, respectively. As a result, as drive shaft 254 is driven in the direction indicated by arrow 332 (shown in FIG. 10), rotors 262A-262F are rotatably driven about axis 268 in the direction indicated by arrow 332 while also having the first staggered pitch between occluding surfaces 282A provided by rollers 290 as shown in FIG. 11. In the particular example, drive surfaces 322 of each set of interfaces 320A-320F and 320A'-320F' are configured to drive rotors 262A-262F such that each roller 290 is not angularly aligned with any other roller 290 of any of rotors 262A-262F while being driven about axis 268 in the direction indicated by arrow 332 (shown in FIG. 10). In the particular example, each roller 290 is angular spaced from an axially consecutive roller 290 by 15 degrees. In other embodiments, the angular spacing between axially consecutive rollers 290 may vary depending on such factors as the number of rollers 290 on each rotor as well as the total number of rotors. For example, in other embodiments in which pump 240 includes a total of N rotors and wherein each rotor includes a total of C equiangularly spaced occluding surfaces 282A, such as provided by rollers 290, the first staggered pitch of drive surfaces 322 as well as the corresponding first staggered pitch of rollers 290 is 360/NC degrees. Although drive surfaces 322 of interfaces 320A-

320F and interfaces 320A'-320F' are illustrated as having uniform angular spacings between axially consecutive drive surfaces 322, in other embodiments, such spacings may be non-uniform or irregular.

Figure 12:
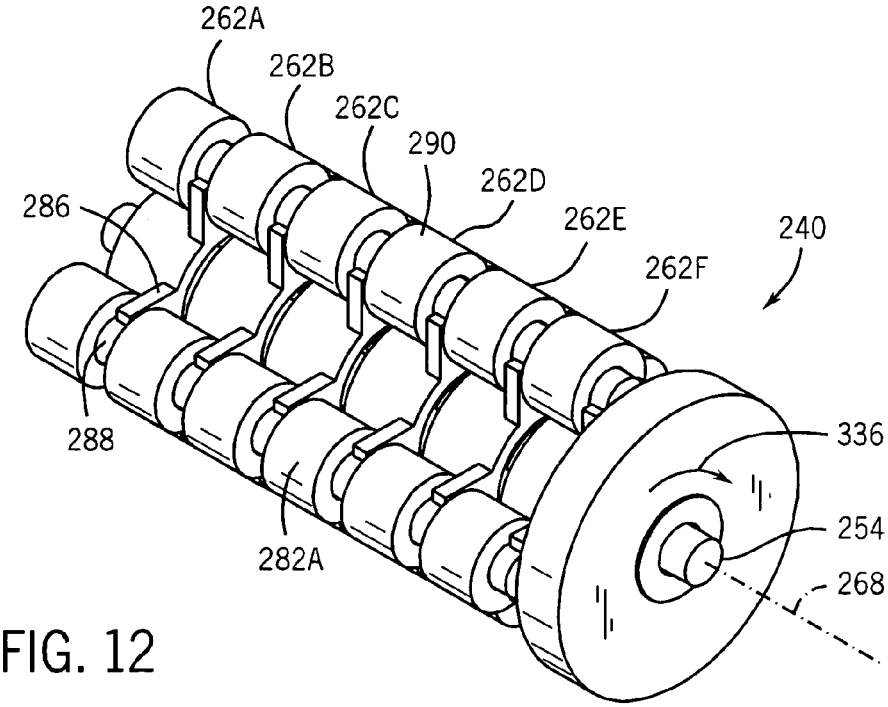
FIG. 12 is a perspective view of the rotors and the drive shaft of FIG. 8 with the rotors having an off pitch, according to an exemplary embodiment.

Because drive surfaces 324 of interfaces 320A-320F are angularly aligned with one another and because drive surfaces 324 of interfaces 320A'-320F' are angularly aligned with one another, drive surfaces 324 of interfaces 320A-320F simultaneously engage engagement surfaces 304 of hubs 284 of rotors 262A-262F, respectively, when drive shaft 254 is rotatably driven by torque source 318 about axis 268 in the direction indicated by arrow 336. At the same time; drive surfaces 324 of interfaces 320A'-320F' simultaneously engage engagement surfaces 308 of hubs 284 of rotor 262A-262F, respectively, when drive shaft 254 is rotatably driven about axis 268 in the direction indicated by arrow 336. As shown by FIG. 12, this results in each of rotors 262A-262F being rotatably driven about axis 268 in the direction indicated by arrow 336 while in angular alignment with one another such that each occluding surface 282 and each roller 290 of each rotor 262A-262F is in angular alignment with an occluding surfaces 282 and a roller 290 of every other rotor 262A-262F when drive shaft 254 and rotors 262A-262F are rotatably driven in the direction indicated by arrow 336.

As further shown by FIG. 10, drive shaft 254 additionally includes keys or splines 337. Splines 337 are configured to be received within corresponding key ways or openings within a drive element such as a gear, pulley or the like. For example, splines 337 may be configured to be received within corresponding openings within a gear such as gear 97. As a result, drive shaft 254 may be easily mounted to alternative gears or other drive elements. In other embodiments, splines 337 may have other configurations or may be omitted in those embodiments wherein drive shaft 254 is integrally formed with a drive element or is connected to a drive element by other means.

Figure 13:
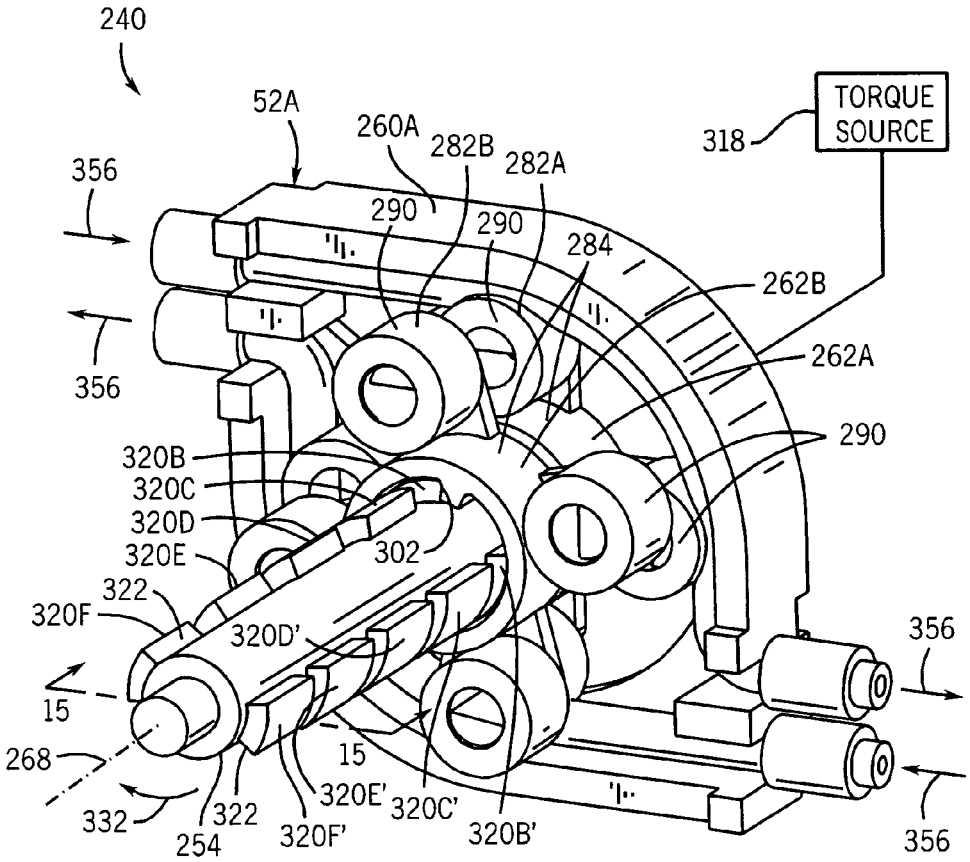
FIG. 13 is a perspective view of the pump of FIG. 2 while the rotors have a staggered pitch and with portions removed for purposes of illustration, according to an exemplary embodiment.
Figure 14:
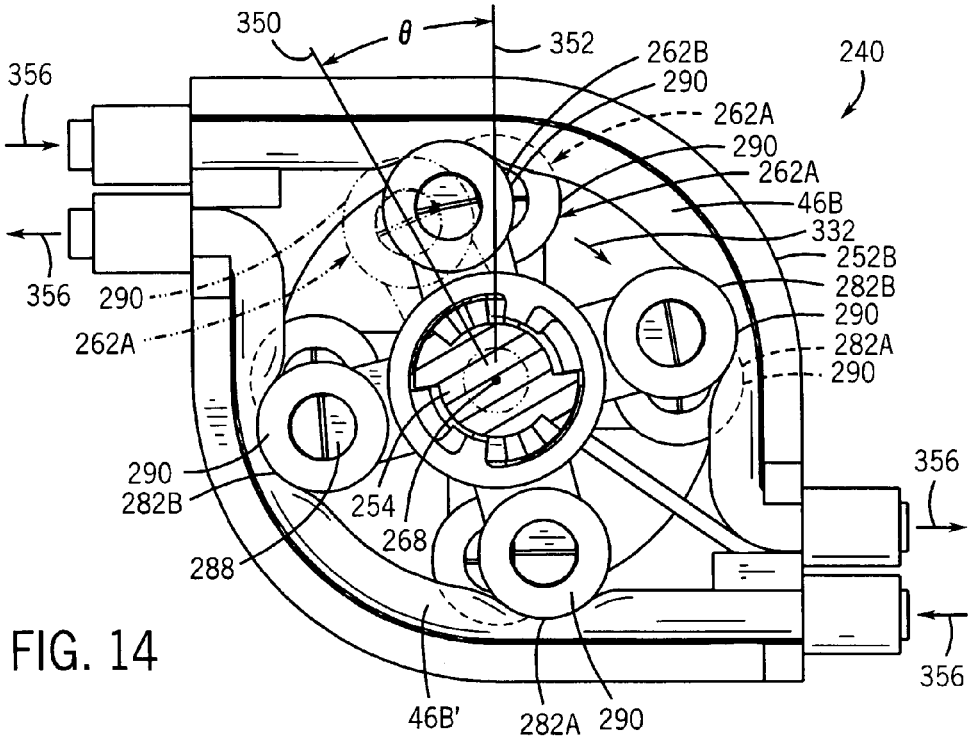
FIG. 14 is a side elevational view of the pump of FIG. 13 further illustrating movement of a rotor through a tube compression phase.
Figure 15:
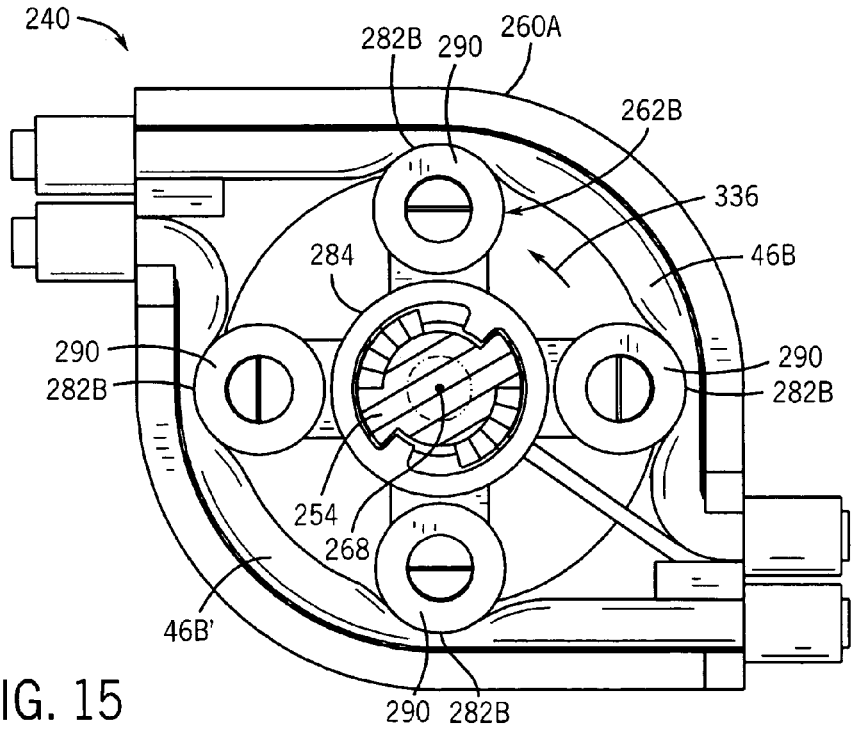
FIG. 15 is a side elevational view of the pump of FIG. 13 with the rotors having the off pitch, according to an exemplary embodiment.

FIGS. 13-15 illustrate the operation of pump 240. FIGS. 13 and 14 illustrate torque source 318 rotatably driving rod shaft 254 about axis 268 in the direction indicated by arrow 332. Initially, drive shaft 254 may rotate relative to rotors 262A, 262B (shown in FIGS. 13 and 14) as well as rotors 262C-262F (shown in FIG. 11) within channel 328 until drive surfaces 322 of interfaces 320A-320F and 320A'-320F' are brought into contact and engagement with engagement surfaces 302 and 306 of hubs 284 of rotors 262A, 262B (shown in FIG. 13) and of rotors 262C-262F (shown in FIG. 11). Because drive surfaces 322 of interfaces 320A-320F and because drive surfaces 322 of interfaces 320A'-320F' have a staggered pitch, rotors 262A and 262B and their associated occluding surfaces 282A and 282B provided by rollers 290 also are driven with a staggered pitch.

As shown by FIG. 14, as rotor 262A is rotatably driven about axis 268, each of its occluding surfaces 282A provided by each roller 290 alternates between a tube-compressing state in which the occluding surface 282A compresses one of tubes 46A and 46A' and an uncompressed state in which a particular occluding surface 282A is not compressing either of tubes 46A and 46A'. FIG. 14 specifically illustrates movement of a roller 290 of rotor 262A through a tube compression phase (indicated by angle θ) during which the roller 290 moves from a compression initiation location (indicated by roller 290, shown in phantom extending along radial line 350) to a maximum compression location (indicated with the same roller 290 shown in solid lines and extending along radial line 352). It has been observed that torque source 318 experiences a torque increase during movement of each roller 290 through the tube compression phase.

In the particular example shown in which each rotor 262A-262F includes four occluding surfaces provided by four spaced rollers 290, torque source 318 will experience four torque increases for each full revolution of each rotor 262A-262F. However, because rotors 262A-262F have a staggered pitch relative to one another and because each roller 290 is angularly offset relative to every other roller 290 of rotors 262A-262F, each roller 290 will move through the tube compression phase at different times as compared to the remaining rollers 290. Because none of the tube compression phases of rollers 290 coincide with one another, the peak magnitude of torque required of torque source 318 by pump 240 is reduced. In contrast, had each of rotors 262A-262F been angularly aligned with one another such that the tube compression phases of each of rollers 290 of each of rotors 262A-262F are coincident with one another, the peak magnitude of torque required of torque source 318 would be six times larger than the peak torque of a single rotor caused by each of the six rotors 262A-262F simultaneously moving through the tube compression phase.

Because rotors 262A-262F are equiangularly spaced from one another while being rotatably driven in the direction indicated by arrow 332, torque source 318 experiences a relatively constant torque demand from pump 240. In other embodiments, rotors 262A-262F may not be equiangularly offset from one another while being driven in the direction indicated by arrow 332. This would result in torque source 318 experiencing an inconsistent torque demand from pump 240.

FIG. 15 illustrates drive shaft 254 being rotatably driven about axis 268 in the direction indicated by arrow 336. Initially, interfaces 320A-320F and 320A'-320F' may rotate relative to one or more of rotors 262A-262F, respectively, until drive surfaces 324 are moved into contact and engagement with engagement surfaces 304 and 308 of hubs 284 of rotors 262A-262F. In instances where rotors 262A-262F have a staggered pitch as a result of being rotatably driven in the direction indicated by arrow 332 (shown in FIG. 14), rotation of drive shaft 254 in the direction indicated by arrow 336 will result in drive surfaces 324 of interfaces 320A-320F and of interfaces 320A'-320F' being sequentially brought into engagement and contact with engagement surfaces 304 and 308. As shown by FIG. 15, once drive surfaces 324 of each of interfaces 320A-320F and interfaces 320A'-320F' are in engagement with engagement surfaces 304 and 308 of rotor 262A-262F, respectively, each of rotors 262A-262F will be in angular alignment with one another. As a result, each occluding surface 282A-282F and each roller 290 will be in angular alignment with a roller 290 of every other rotor 262A-262F.

When pump 240 is not operating, rollers 290 may be stationarily positioned in a tube-compressing state for a prolonged period of time. As a result, a compression set will form in each tube. Upon start up of a pump 240, the torque source 318 (shown in FIG. 13) will experience a torque increase each time an occluding surface 282A, such as a roller 290, moves across the compression set in its respective tube 46A, 46A'.

During normal operation of pump 240, torque source 318 rotatably drives drive shaft 254 to rotate rotors 262A-262F about axis 268 in the direction shown by arrow 332 in FIG. 14. This results in fluid being pumped in the direction indicated by arrows 356. As discussed above, because rotors 262A-262F have a staggered pitch, the torque required of torque source 318 by each rotor 262A-262F is also staggered, minimizing any peak torque required of torque source 318 by pump 240 during such pumping. Once pumping of fluid has been completed, torque source 318 rotatably drives drive shaft 254 in the direction indicated by arrow 336 as shown in FIG. 15. This results in each of rotors 262A-262F and their respective rollers 290 being moved into angular alignment with one another. As a result, any compression sets that are formed in tubes 46A-46F and 46A'-46F' (shown in FIG. 2) will also be in angular alignment with one another.

Upon start up of pump 240 in which torque source 318 drives drive shaft 254 in the direction indicated by arrow 332 in FIG. 14, each of rotors 262A-262F will once again be driven with a staggered pitch. As a result, the time at which each roller 290 of each rotor 262A-262F encounters and moves through a formed compression set in tubes 46A-46F and 46A'-46F' will also be staggered. The compression sets are in angular alignment with one another while rollers 290 of rotor 262A-262F are driven while having a staggered pitch relative to one another. Consequently, the peak magnitude of torque required of torque source 318 by pump 240 upon start up of pump 240 is reduced.

Although the reduction of the peak magnitude of torque required of torque source 318 by pump 240 upon start up is illustrated as being reduced by angularly aligning the rollers 290 of rotors 262A-262F prior to shut down such that the resulting compression sets within tubes 46A-46F and 46A'-46F' are also angularly aligned with one another, the peak magnitude of torque required of torque source 318 by pump 240 may alternatively be reduced by repositioning rotors 262A-262F prior to shut down With other off pitches. In lieu of having an off pitch wherein rotors 262A-262F are in angular alignment with one another, rotors 262A-262F may have an off pitch wherein rotors 262A-262F are angularly offset from one another but with a pitch distinct from the staggered pitch at which rotors 262A-262F are driven about axis 268 in the direction indicated by arrow 332 in FIG. 14.

Although each of rotors 262A-262F has been described as being moved to the off pitch shown in FIG. 15 just prior to shut down, rotors 262A-262F may also be rotatably driven about axis 268 in the direction indicated by arrow 336 so as to pump fluid through tubes 262A-262F and 262A'-262F' in directions opposite to arrows 356 shown in FIG. 14.

FIGS. 1, 2 and 6-15 illustrate but one example of peristaltic pump 240. Although pump 240 is illustrated as having six rotors 262A-262F, pump 240 may alternatively have a greater or fewer number of such rotors. Although each rotor is illustrated as having four equiangularly spaced occluding surfaces provided by rollers 290, one or more of rotors 262A-262F may alternatively have a greater or fewer number of such rollers 290 or other occluding surfaces. Although pump 240 is illustrated as having drive shaft 254 which passes through each of rotors 262A-262F and engages each of rotors 262A-262F through the interaction between interfaces 320A-320F and 320A'-320F' with projections 296 and 298, drive shaft 254 may interact with rotors 262A-262F in other fashions. For example, in lieu of drive shaft 354 having drive surfaces 322 with a staggered pitch and having drive surfaces 324 with an off pitch while hubs 284 have axially extending projections 296 and 298, drive shaft 254 may alternatively have axially extending projections similar to projections 296 and 298 while hubs 284 of rotor 262A-262F have one or more sets of drive surfaces 322 with a staggered pitch and one or more sets of drive surfaces 324 with an off pitch. In still other embodiments, drive shaft 354 may be omitted, wherein axially adjacent rotors 262A-262F are configured to interact with one another so as to transmit torque from one rotor to the next. In such an alternative embodiment, the consecutive rotors are configured such that rotation of the rotors in a first direction results in the occluding surfaces of the rotors having a staggered pitch relative to one another and such that rotation of the rotors in an opposite direction results in the occluding surfaces of the rotors having an off pitch relative to one another.

Although the present invention has been described with reference to example embodiments, workers skilled in the art will recognize that changes may be made in form and detail without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. Because the technology of the present invention is relatively complex, not all changes in the technology are foreseeable. The present invention described with reference to the example embodiments and set forth in the following claims is manifestly intended to be as broad as possible. For example, unless specifically otherwise noted, the claims reciting a single particular element also encompass a plurality of such particular elements.

What is claimed is:

1. A peristaltic pump comprising:

opposing occlusion surfaces;

a rotor between the occlusion surfaces and carrying a set of occluding surfaces fixed relative to one another, wherein at least one of either the set of occluding surfaces or the opposing occlusion surfaces are linearly movable relative to the other of the set of occluding surfaces and the occlusion surfaces during pumping;

a first compressible conduit extending between the set of occluding surfaces and one of the occlusion surfaces;

a second compressible conduit extending between the set of occluding surfaces and the other of the occlusion surfaces, wherein at least one of either the set of occluding surfaces or the opposing occlusion surfaces are linearly movable relative to the other of the set of occluding surfaces and occlusion surfaces by a distance sufficient such that substantially equal compression forces are applied to the first compressible conduit and the second compressible conduit, wherein the set of occluding surfaces are linearly movable relative to the occlusion surfaces;

a housing providing the opposing occlusion surfaces, wherein the rotor is linearly movable relative to the housing; and a drive shaft extending along an axis and coupled to the rotor, wherein the rotor is linearly movable relative to the shaft in a direction non-parallel to the axis.

2. The pump of claim 1 wherein the rotor is linearly movable relative to the shaft through a distance perpendicular to the axis of at least 0.4 millimeters.

3. A peristaltic pump comprising:

opposing occlusion surfaces;

a rotor between the occlusion surfaces and carrying a set of occluding surfaces fixed relative to one another, wherein at least one of either the set of occluding surfaces or the opposing occlusion surfaces are linearly movable relative to the other of the set of occluding surfaces and the occlusion surfaces during pumping;

a first compressible conduit extending between the set of occluding surfaces and one of the occlusion surfaces;

a second compressible conduit extending between the set of occluding surfaces and the other of the occlusion surfaces, wherein at least one of either the set of occluding surfaces or the opposing occlusion surfaces are linearly movable relative to the other of the set of occluding surfaces and occlusion surfaces by a distance sufficient such that substantially equal compression forces are applied to the first compressible conduit and the second compressible conduit, wherein at least one of either the set of occluding surfaces or the opposing occlusion surfaces are linearly movable relative to the other of the set of occluding surfaces and the occlusion surfaces during pumping of fluid by a distance of at least 2.0% $D_{mean}$, wherein $D_{mean}$ is equal to one-half the sum of the distance between opposing occlusion surfaces and the distance between opposing occluding surfaces.

4. A peristaltic pump comprising:

a plurality of pump units arranged in a stack, each pump unit including:

a rotor carrying a set of rollers providing a set of occluding surfaces; and a housing having a half-clamshell shape, wherein the housing includes:

a main wall extending generally perpendicular to a rotational axis of the rotor and opposite to axial ends of each of the rollers;

a first rim fixed to and extending from the wall in a first direction and providing one of a set of opposing occlusion surfaces; and a second rim fixed to and extending from the wall in the first direction and providing the other of the set of opposing occlusion surfaces.

5. The pump of claim 4 including a drive shaft coupled to the rotor of each of the plurality of pump units.

6. The pump of claim 4 including a frame continuously extending between and engaging a first end of the pump units and a second end of the pump units to retain the pump units relative to one another.

7. The pump of claim 4 including a frame in engagement with the plurality of pump units so as to prevent rotation of the pump units.

8. The pump of claim 4 wherein the pump units extend along an axis and wherein the pump units are linearly movable in directions non-parallel to the axis.

9. The pump of claim 4 wherein the plurality of pump units includes a first pump unit and a second consecutive pump unit and wherein the housing of the first pump unit borders the at least one occlusion surface of the second pump unit and is configured to retain a tube along the at least one occlusion surface of the second pump unit.

10. The pump of claim 4 wherein the plurality of pump units includes a first pump unit and a second pump unit and wherein the housing of the first pump unit and the housing of the second pump unit cooperate to surround the rotor of the first pump unit.

11. The pump of claim 4 wherein the pump units are substantially identical to one another.

12. The pump of claim 4 wherein the at least one occlusion surface includes opposing occlusion surfaces and wherein the rotor is between the opposing occlusion surfaces.

13. The pump of claim 12 wherein at least one of either the set of occluding surfaces or the opposing occlusion surfaces are linearly movable relative to the other of the set of occluding surfaces and the occlusion surfaces during pumping.

14. The pump of claim 13 wherein the opposing occlusion surfaces linearly move relative to the set of occluding surfaces.

15. The pump of claim 14, wherein the housing is integrally formed as a single unitary body.

16. The pump of claim 13 wherein the set of occluding surfaces are linearly movable relative to the occlusion surfaces.

17. The pump of claim 16 including a housing providing the opposing occlusion surfaces, wherein the rotor is linearly movable relative to the housing during pumping.

18. The pump of claim 17 including a drive shaft extending along an axis and coupled to the rotor, wherein the rotor is linearly movable relative to the shaft in a direction non-parallel to the axis.

19. The pump of claim 12 including a first compressible conduit extending between the set of occluding surfaces and one of the occlusion surfaces.

20. The pump of claim 19 including a second compressible conduit extending between the set of occluding surfaces and the other of the occlusion surfaces.

21. The pump of claim 19 wherein the first compressible conduit extends between the set of occluding surfaces and the other of the occlusion surfaces.

22. The pump of claim 4 wherein the rotor includes:

at least one post support; and a plurality of posts extending from the at least one post support in a single direction and carrying the set of occluding surfaces, wherein the at least one post support and the plurality of posts are integrally formed as a unitary body.

23. The pump of claim 4 wherein the plurality of pump units includes a first pump unit and a second pump unit and wherein the set of occluding surfaces of the first pump unit and the set of occluding surfaces of the second pump unit have a staggered pitch.

24. The pump of claim 23 wherein at least one of the set of occluding surfaces of the first pumping unit and the set of occluding surfaces of the second pumping unit are movable between a first position in which the set of occluding surfaces of the first pumping unit and the set of occluding surfaces of the second pumping unit have the staggered pitch and a second position in which the set of occluding surfaces of the first pumping unit and the second pumping unit have an off pitch.

25. The pump of claim 24 wherein the set of occluding surfaces of the first pumping unit and the set of occluding surfaces of the second pumping unit are angularly aligned in the second position.

26. The pump of claim 23 wherein at least one of the rotor of the first pumping unit and the rotor of the second pumping unit is rotatable about an axis between a first position in which the rotor of the first pumping unit and the rotor of the second pumping unit have a staggered pitch and a second position in which the rotor of the first pumping unit and the rotor of the second pumping unit have an off pitch.

27. The pump of claim 26 wherein said at least one rotor of the first pumping unit and the rotor of the second pumping unit rotates to the first position in response to the rotors being rotatably driven in a first direction and wherein said at least one rotor of the first pumping unit and the rotor of the second pumping unit rotates to the second position in response to the rotors being rotatably driven in a second opposite direction.

28. The pump of claim 4 wherein the opposing occlusion surfaces are configured to resiliently flex away from one another.

29. The pump of claim 4 wherein the set of occluding surfaces is configured to resiliently flex away from the opposing occlusion surfaces.

30. The pump of claim 29 wherein the opposing occlusion surfaces are configured to resiliently flex away from one another.

31. The pump of claim 4 wherein the plurality of pump units are arranged so as to form a stack.

32. An image forming device comprising:

at least one fluid dispensing device configured to dispense fluid upon a medium;

a fluid reservoir; and a pump comprising:

tubes in fluid communication with a fluid reservoir and the at least one fluid dispensing device;

opposing occlusion surfaces; and a rotor carrying a set of occluding surfaces between the opposing occlusion surfaces wherein at least one of either the set of occluding surfaces or the opposing occlusion surfaces are linearly movable relative to the other of the set of occluding surfaces and the occlusion surfaces, wherein at least one of either the set of occluding surfaces or the opposing occlusion surfaces are linearly movable relative to the other of the set of occluding surfaces and the occlusion surfaces during pumping of fluid by a distance of at least 2.0% $D_{mean}$, wherein $D_{mean}$ is equal to one-half the sum of the distance between opposing occlusion surfaces and the distance between opposing occluding surfaces.

33. A method for pumping fluid, the method comprising:

rotating a set of occluding surfaces with a drive shaft to compress a first tube portion against a first occlusion surface and a second tube portion against a second opposite occlusion surface;

floating at least one of either the set of occluding surfaces or the first and second occlusion surfaces in response to unequal compression forces being applied to the first tube portion and the second tube portion, wherein the set of occlusion surfaces are immovable relative to one another and wherein movement of one of the set of occlusion surfaces relative to the drive shaft results in movement of the other of the set of occlusion surfaces with respect to the drive shaft.

34. The pump of claim 16, wherein the rotor is configured such that force exerted upon one of the occluding surfaces results in movement of another of the occluding surfaces.

35. The pump of claim 34, wherein the rotor is configured to sufficiently move to automatically center itself between the opposing occlusion surfaces.

36. A peristaltic pump comprising:

opposing occlusion surfaces;

a rotor between the occlusion surfaces and carrying a set of occluding surfaces, wherein at least one of either the set of occluding surfaces or the opposing occlusion surfaces are linearly movable relative to the other of the set of occluding surfaces and the occlusion surfaces, wherein the opposing occlusion surfaces are fixedly coupled to one another and linearly move relative to the set of occluding surfaces; and a housing providing the opposing occlusion surfaces, wherein the housing is linearly movable relative to the set of occluding surfaces through a distance perpendicular to a rotational axis of the rotor of at least 0.2 millimeters.

37. The pump of claim 36, wherein the housing includes a portion extending between and connecting the set of occlusion surfaces and wherein an entirety of the housing including the portion moves in unison in response to movement of one of the occlusion surfaces.

38. A peristaltic pump comprising:

opposing occlusion surfaces;

a rotor between the occlusion surfaces and carrying a set of occluding surfaces fixed relative to one another, wherein at least one of either the set of occluding surfaces or the opposing occlusion surfaces are linearly movable relative to the other of the set of occluding surfaces and the occlusion surfaces during pumping, wherein the set of occluding surfaces are linearly movable relative to the occlusion surfaces;

a housing providing the opposing occlusion surfaces, wherein the rotor is linearly movable relative to the housing; and a drive shaft extending along an axis and coupled to the rotor, wherein the rotor is linearly movable relative to the shaft in a direction non-parallel to the axis.

39. The pump of claim 38 wherein the rotor is linearly movable relative to the shaft through a distance perpendicular to the axis of at least 0.4 millimeters.

* * * * *